US008265512B2

(12) United States Patent
Endo

(10) Patent No.: US 8,265,512 B2
(45) Date of Patent: Sep. 11, 2012

(54) POWER SUPPLY UNIT FOR IMAGE FORMING APPARATUS AND IMAGE FORMING APPARATUS

(75) Inventor: Katsuya Endo, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 342 days.

(21) Appl. No.: 12/753,164

(22) Filed: Apr. 2, 2010

(65) Prior Publication Data

US 2010/0254726 A1 Oct. 7, 2010

Related U.S. Application Data

(60) Provisional application No. 61/167,062, filed on Apr. 6, 2009, provisional application No. 61/167,070, filed on Apr. 6, 2009.

(51) Int. Cl.
*G03G 15/00* (2006.01)
*G03G 21/20* (2006.01)

(52) U.S. Cl. ..... 399/88; 399/92

(58) Field of Classification Search ..... 399/37, 399/88, 92

See application file for complete search history.

(56) References Cited

U.S. PATENT DOCUMENTS

| | | | | |
|---|---|---|---|---|
| 7,313,341 | B2 * | 12/2007 | Matsusaka | 399/88 |
| 7,639,963 | B2 * | 12/2009 | Matsuo | 399/88 |
| 7,855,471 | B2 * | 12/2010 | Sugawara | 307/46 |
| 2006/0002732 | A1 * | 1/2006 | Hwang et al. | 399/88 |
| 2006/0177236 | A1 * | 8/2006 | Kowari et al. | 399/88 |
| 2006/0285867 | A1 | 12/2006 | Takahashi et al. | |

FOREIGN PATENT DOCUMENTS

| | | | |
|---|---|---|---|
| JP | 05301419 | A | * 11/1993 |
| JP | 9-212066 | A | 8/1997 |
| JP | 2005-26860 | A | 1/2005 |
| JP | 2007-3641 | A | 1/2007 |
| JP | 2007-47472 | A | 2/2007 |
| JP | 2008-122914 | A | 5/2008 |

* cited by examiner

*Primary Examiner* — Robert Beatty
(74) *Attorney, Agent, or Firm* — Patterson & Sheridan, LLP

(57) ABSTRACT

A first power system supplies electric power to a first control circuit. A second power system supplies electric power to a load further on a downstream side than the second power system. A second control circuit receives the supplied electric power from a commercial power supply. In a power saving mode, a path switching section switches an electric power supply path to interrupt the electric power from the second power system to a cooling fan and supply electric power from an electricity storing section to the cooling fan.

20 Claims, 12 Drawing Sheets

POWER SUPPLY UNIT FOR IMAGE FORMING APPARATUS AND IMAGE FORMING APPARATUS

CROSS-REFERENCE TO RELATED APPLICATION

The present application claims priority under 35 U.S.C. 119 to U.S. Provisional Application Ser. No. 61/167,062, entitled IMAGE FORMING APPARATUS, to Endo, filed on Apr. 6, 2009 and Provisional Application Ser. No. 61/167,070, entitled POWER SUPPLY UNIT FOR IMAGE FORMING APPARATUS, to Endo, filed on Apr. 6, 2009, the entire disclosure of which is incorporated herein by reference.

TECHNICAL FIELD

The present invention relates to a power supply unit for an image forming apparatus and the image forming apparatus.

BACKGROUND

The International Energy Star Program establishes specifications concerning energy saving. The Energy Star Program sets, for the field of copying machines and MFPs (Multi Function Peripherals), plural operation modes for an image forming apparatus and levels of power consumption required in the respective modes.

One of methods for saving power consumption in the image forming apparatus is to eliminate electric power supplied to a heat roller of a fixing device when the image forming apparatus is in a standby state. However, in the method of saving electric power, when the image forming apparatus starts, it takes time for the temperature of the heat roller to reach fixable temperature.

Therefore, there is a demand for causing the temperature of the heat roller to quickly reach the fixable temperature and reducing power consumption in the image forming apparatus.

Hasegawa (JP-A-2008-122914) discloses an image forming apparatus configured to reduce time required for a rise in the temperature of a heat roller. Hasegawa discloses that electric power is supplied to a heat generating member using an auxiliary power supply device in addition to a main power supply. Hasegawa discloses that the auxiliary power supply device includes a chargeable and dischargeable electricity storage member, a charged electricity detecting unit configured to detect charged electricity of the electricity storage member, and a switching unit configured to switch charging and discharging of the electricity storage member.

A control section transitions a state of the image forming apparatus among plural operation modes. The operation modes include a normal mode and power saving modes. The normal mode is, for example, a copy mode. In the copy mode, a print engine executes printing.

The power saving modes include a ready mode after the end of printing, an electricity saving mode for lowering the temperature of a fixing device, and a sleep mode for inactivating most of components.

Respective mode names of the normal mode and the power saving modes are variously determined according to ranges of levels of electric power specified by the Energy Star Program.

When printing ends, the control section transitions the image forming apparatus from the copy mode to the ready mode. In the ready mode, the control section controls the temperature of the heat roller to be fixed at fixable temperature. When the image forming apparatus does not receive operation from a user for a set time, the control section leaves the ready mode and enters the electricity saving mode.

In the electricity saving mode, the control section turns off main power supply lines except only a part of power saving lines. When the image forming apparatus is not operated by the user for a predetermined time in the electricity saving mode, the control section transitions the image forming apparatus to the sleep mode.

A reduction in power consumption in the electricity saving mode is further explained below.

In the electricity saving mode, the control section lowers the temperature of the fixing device below temperature in a normal standby state of the fixing device.

When the image forming apparatus just finishes printing, the control section gradually lowers the temperature of the fixing device while monitoring the temperature of components of a process system. The process system components indicate a photoconductive drum, a charger, a developing device, a charge removing device, a cleaner, and the like.

In the electricity saving mode, in order to exhaust ozone, the control section needs to supply electric power to a control circuit and a driving section and drive a temperature detecting circuit of the fixing device and fan motors.

Corona discharge by the charger generates ozone. Excessive residual ozone prevents ionization of the air in the next charging. Nitrogen oxides harmful to an image are formed on a photoconductive member by reaction of water due to dew formation and the zone.

Concerning a fan configured to discharge ozone, JP-A-1997-212066 discloses an image forming apparatus in which fans are respectively provided in plural units to make it possible to control cooling by the fans and a flow of the air.

In the electricity saving mode, the control section causes power supply circuits for the heat roller of the fixing device, the fan motors, and the like to continue to operate. A power supply section includes a switching circuit configured to generate low-voltage power. The control section causes the switching circuit to continue to oscillate.

Even in the electricity saving mode, the control section causes the low-voltage power supply to supply electric power to the fan motor of the fan for cooling the process system components and the fan motor of the fan for exhausting ozone generated in high-voltage components. However, the supply of electric power from the low-voltage power supply in the electricity saving mode deteriorates efficiency of use of the power supply.

The operation of the motors and the operation of the temperature detecting circuit in the electricity saving mode increases consumption of electric power on a primary side. Therefore, power consumption of the image forming apparatus as a whole is not improved.

SUMMARY

It is an object of the present invention to provide a power supply unit for an image forming apparatus configured to reduce power consumption in a power saving mode.

In an aspect of the present invention, a power supply unit for an image forming apparatus includes: a first control circuit configured to control the image forming apparatus, to be transitioned among plural operation modes including a normal mode in which the image forming apparatus operates at normal power consumption and a power saving mode in which the image forming apparatus operates at other power consumption lower than the normal power consumption; a first power system configured to receive first electric power supplied from a commercial power supply, and supply second electric power to at least the first control circuit; a second power system configured to receive the first electric power, and supply third electric power to a load further on a downstream side than the second power system; an electricity storing section provided on a downstream side in a power supplying direction of the second power system and charged by the third electric power in the normal mode; a switch configured to turn off and on the first electric power to the second power system in association with open and close of a body cover, and generate fourth electric power; a second control circuit to which the fourth electric power is supplied through the switch; a cooling fan controlled by the second control circuit and configured to receive the third electric power; and a path switching section driven by the second control circuit and configured to switch, in the power saving mode, an electric power supply path to interrupt the third electric power to the cooling fan and supply fifth electric power from the electricity storing section to the cooling fan.

DETAILED DESCRIPTION

Figure 1:
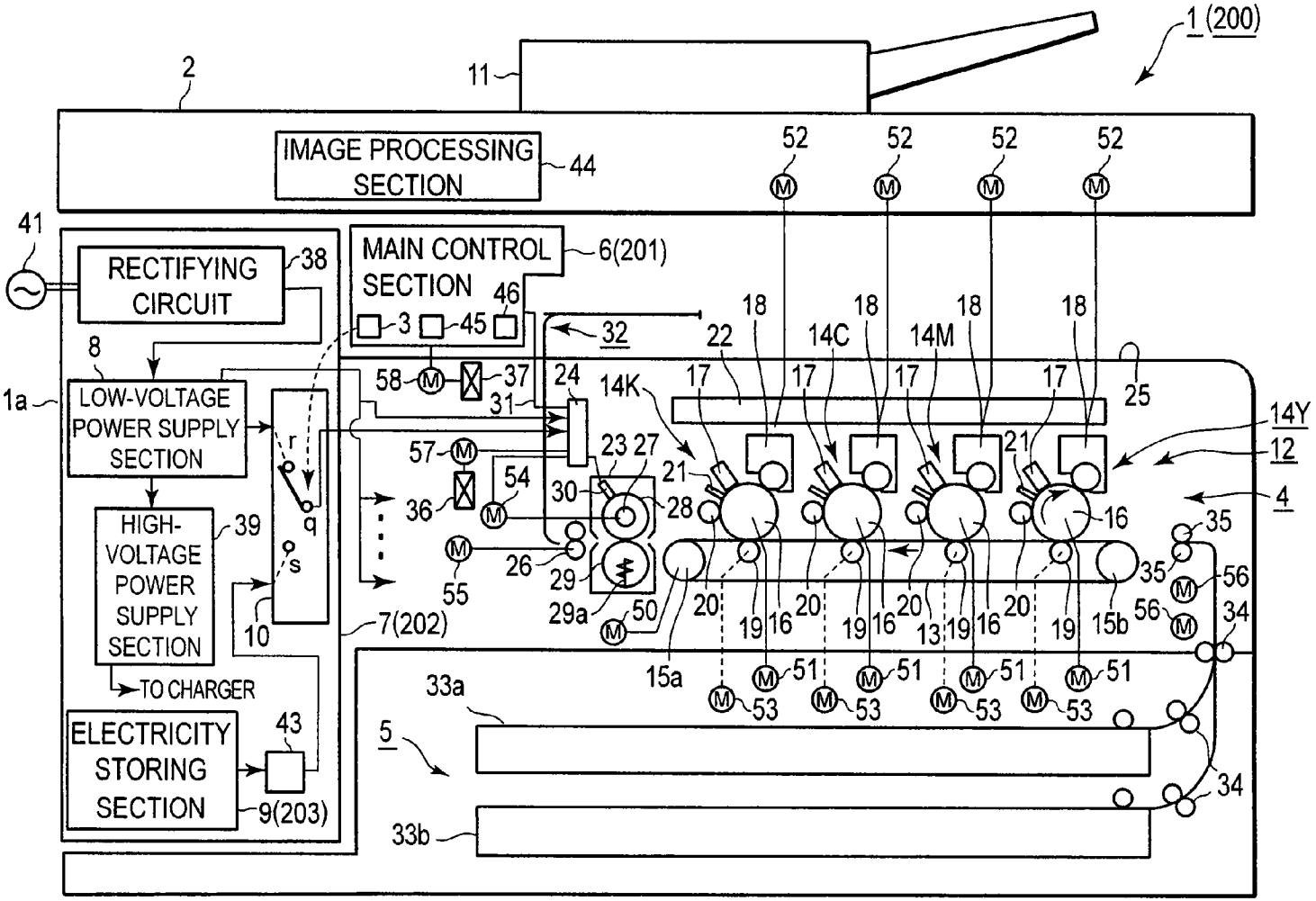
FIG. 1 is a diagram of the configuration of an image forming apparatus according to a first embodiment.

Throughout this description, the embodiments and examples shown should be considered as exemplars, rather than limitations on the apparatus of the present invention.

Power supply units for image forming apparatuses and the image forming apparatuses are explained in detail below with reference to the accompanying drawings. Same components are denoted by the same reference numerals and signs in figures and redundant explanation of the components is omitted.

(First Embodiment)

An image forming apparatus according to a first embodiment is a color copying machine. A power supply unit for the image forming apparatus according to the first embodiment is a power unit provided in the color copying machine.

FIG. 1 is a diagram of the configuration of a color copying machine. A color copying machine 1 includes a machine body 1*a*, a scanner section 2, an image processing section 44, a printer section 4, a paper feeding section 5, a main control section 6, and a power supply section 7.

A document feeder 11 on the scanner section 2 inserts an original document into the scanner section 2. The scanner section 2 scans the original document and converts image information read from the original document into an analog signal. The image processing section 44 converts three-color image data from the scanner section 2 into four print colors.

The printer section 4 forms an image on a sheet and outputs the sheet. The printer section 4 includes an image forming unit 12. The paper feeding section 5 feeds a sheet to the printer section 4.

The main control section 6 manages control of the operation of the overall color copying machine 1. The main control section 6 includes a CPU (Central Processing Unit) 3, a mechanical controller 45, a ROM (Read Only Memory) 46, and a RAM (Random Access Memory).

The mechanical controller 45 outputs control signals to not-shown plural motor drivers. The motor drivers are ICs (Integrated Circuits) configured to send control signals to a fan motor of a cooling fan.

The CPU 3 determines one mode among a copy mode and plural power saving modes. The CPU 3 functions as a first control circuit for a power supply unit 74 explained later.

The motor drivers also drive rollers provided in the printer section 4, a scanning member for a laser beam, and motors used for drums.

Motor driver circuits having semiconductor devices configured to output high and low signals are used for the motor drivers. The motor drivers are respectively provided on driving boards. The driving boards can respectively exchange signals with the main control section 6.

The mechanical controller 45 outputs, on the basis of image data output by the image processing section 44, control signals to the motor drivers and controls the operation of the motors.

The image forming unit 12 includes image forming stations 14Y, 14M, 14C, and 14K for yellow (Y), magenta (M), cyan (C), and black (K) provided in parallel to one another along a belt 13.

The belt 13 is an intermediate transfer belt. The belt 13 travels in an arrow direction according to the rotation of a roller 15*a* (or a roller 15*b*). A motor 50 rotates the roller 15*a*. The motor 50 is a transfer belt motor.

The image forming station 14Y includes a photoconductive drum 16, a charger 17, a developing device 18, a transfer roller 19, a cleaner 20, and a charge removing device 21.

The configuration of the image forming stations 14M, 14C, and 14K is substantially the same as the configuration of the image forming station 14Y.

Motors 51 are respectively provided for the image forming stations 14Y, 14M, 14C, and 14K. The motors 51 are drum motors.

Motors 52 are respectively provided for the developing devices 18 in the image forming stations 14Y, 14M, 14C, and 14K. The motors 52 are developing motors.

The transfer rollers 19 are a part of transfer devices. The transfer devices transfer toner images formed on the photoconductive drums 16 onto a sheet. Motors 53 are provided for the transfer rollers 19. The motors 53 are transfer motors. All the motors 50, 51, 52, and 53 are driven by motor drivers on not-shown boards for driving.

The image forming unit 12 includes a laser exposing device 22 above the image forming stations 14Y, 14M, 14C, and 14K.

The printer section 4 further includes a fixing device 23 provided downstream in a direction in which a sheet is conveyed, a driving board 24 configured to control the fixing device 23, and a paper discharge roller 26 configured to convey the sheet to a paper discharge section 25.

The fixing device 23 includes a heat roller 28 incorporating a heater 27 as a heating source, a press roller 29 applied with elastic force upward by a spring 29*a*, a temperature sensor 30 provided on the surface of the heat roller 28, and a cooling fan 36 provided in a case of the fixing device 23.

The heater 27 is an induction heating coil. A litz wire is used for the heater 27. The heater 27 generates a magnetic flux when a high-frequency current is applied thereto. Fluctuation in the magnetic flux causes the heat roller 28 to generate an eddy-current. The eddy-current and a resistance component of the heat roller 28 cause the heat roller 28 to generate heat.

The heat roller 28 has a cylindrical metal layer. The heat roller 28 is rotated by a motor 54. The motor 54 is, for example, a fixing motor and is driven by a motor driver on the driving board 24.

The press roller 29 is a driven roller. The press roller 29 includes a core and a surface elastic layer around the core. A thermistor is used as the temperature sensor 30.

Main functions of the driving board 24 are heating, rotation driving, and temperature adjustment for the fixing device 23. The driving board 24 and the main control section 6 are connected by a signal line 31.

Figure 2A:
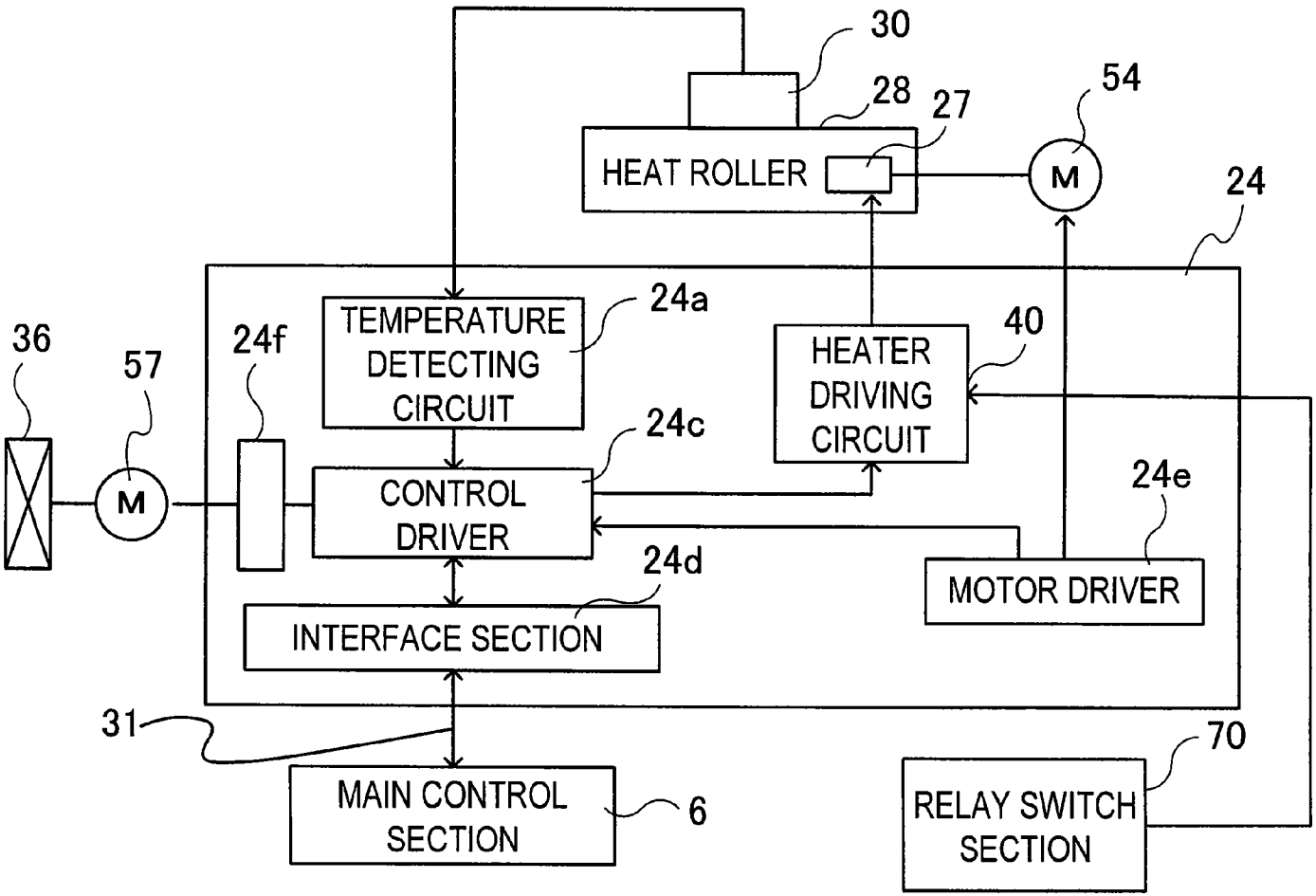
FIG. 2A is a diagram of a configuration example of a driving board.

FIG. 2A is a diagram of a configuration example of the driving board 24. In the figure, components same as those explained above are denoted by the same reference numerals and signs.

The driving board 24 includes a temperature detecting circuit 24*a* configured to detect the surface temperature of the heat roller 28 according to the output of the temperature sensor 30, a control driver 24*c* (a second control circuit) to which a detection signal is output from the temperature detecting circuit 24*a*, and a heater driving circuit 40 for heating the heater 27.

The driving board 24 includes an interface section 24*d* configured to exchange signals between a control driver 24*c* and the main control section 6 via the signal line 31, a motor driver 24*e* configured to drive the motor 54, and a motor driver 24*f* configured to drive a fan motor 57 for rotating the fan 36.

Figure 2B:
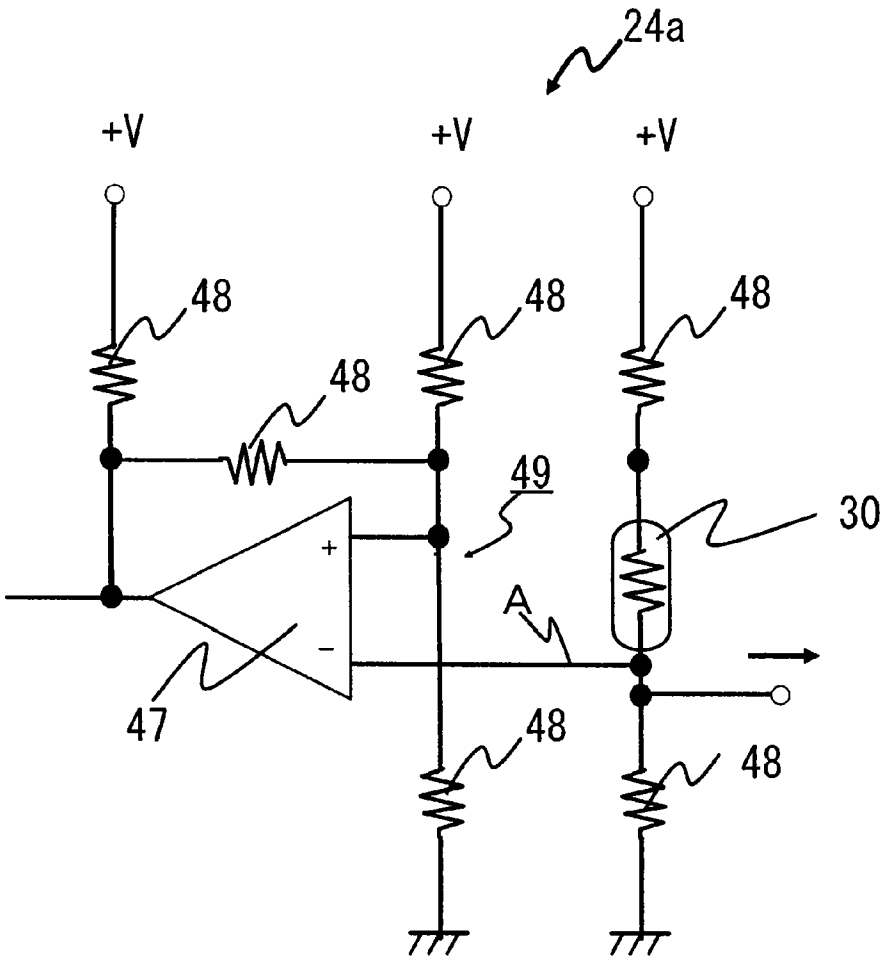
FIG. 2B is a block diagram of a temperature detecting circuit.

The temperature detecting circuit 24*a* includes, for example, as shown in FIG. 2B, a comparator 47, a resistance bias circuit 49 including plural resistors 48 each of which is for biasing, and the temperature sensor 30 itself.

The comparator 47 has two input terminals. The resistance bias circuit 49 is connected to one input terminal. The resistance bias circuit 49 applies a reference voltage to the terminal. The temperature detecting circuit 24*a* outputs the voltage at the other input terminal of the comparator 47 as voltage A. The voltage A is a voltage value obtained by dividing a pull-up voltage with serial connection of one resistor 48, the temperature sensor 30, and the other resistors 48.

The temperature detecting circuit 24*a* inputs the voltage A to the control driver 24*c*. Alternatively, the temperature detecting circuit 24*a* inputs the voltage A to an analog port of the CPU 3. The voltage between the two terminals of the comparator 47 changes according to a change in the resistance value of the temperature sensor 30. The CPU 3 detects the temperature of the fixing device 23.

The heater driving circuit 40 shown in FIG. 2A applies a high-frequency current with high power to the heater 27. The heater driving circuit 40 supplies electric power of several hundred watts to the heater 27. The heater driving circuit 40 outputs electric currents or voltages such that the heater 27 generates heat at plural different power levels.

For example, an inverter circuit is used as the heater driving circuit 40. In the copy mode, a DC voltage is applied to the heater driving circuit 40 from an excitation coil in a relay switch section 70. In an electricity saving mode, the DC voltage applied to the heater driving circuit 40 is interrupted.

In the electricity saving mode, the heater driving circuit 40 stops the electric power to the heater 27 according to an instruction from the main control section 6. In a normal ready mode, the heater driving circuit 40 applies electric power of, for example, 700 W to the heater 27. In the copy mode, the heater driving circuit 40 applies electric power of, for example, 900 W to the heater 27.

The control driver 24*c* outputs control signals indicating power levels corresponding to the copy mode, standby modes (the ready mode, the electricity saving mode, etc.) to the heater driving circuit 40.

The control driver 24*c* is a second control circuit to which electric power is supplied from a commercial AC power supply 41 through the relay switch section 70.

Power levels such as 700 W and 900 W are set in the heater driving circuit 40 by the control driver 24*c*. An LSI (Large Scale Integration) is used as the control driver 24*c*.

A photocoupler is used as the interface section 24*d*. The photocoupler includes two not-shown photoelectric conversion circuits (a first photoelectric conversion circuit and a second photoelectric conversion circuit) respectively having photodiodes and phototransistors.

The photodiode of the first photoelectric conversion circuit optically modulates a signal from the main control section 6. The phototransistor demodulates the signal and transmits the signal to the control driver 24*c*. The same holds true for the second photoelectric conversion circuit configured to transmit a signal from the control driver 24*c* to the main control section 6.

In FIG. 1, the paper discharge roller 26 is driven by a motor 55. The motor 55 is, for example, a discharge motor. A conveying path 32 for leading a sheet after fixing to the paper discharge section 25 is defined.

The paper feeding section 5 includes cassettes 33*a* and 33*b*. Plural rollers 34 are rollers for sheet pickup, sheet separation, and sheet conveyance. A registration roller 35 is a roller for skew correction and sheet conveyance to the image forming station 14Y.

The rollers 34 and the registration roller 35 are rotated by a motor 56. A feed motor or a main motor is used as the motor 56.

The color copying machine 1 includes a fan 37. The fan 37 is provided in the inside of the machine body 1*a* and discharges the air in the machine body 1*a* to the outside of the machine body 1*a*. The color copying machine 1 may include another cooling fan different from the fans 36 and 37.

Both the fans 36 and 37 are controlled by the control driver 24*c* as cooling fans. Electric power is supplied to both the fans 36 and 37 via a coil 70*a*.

The fan 36 is rotated by the fan motor 57. The fan motor 57 is driven by the motor driver 24*f* on the driving board 24. The fan 37 is rotated by a fan motor 58. The fan motor 58 is driven by, for example, the mechanical controller 45.

The motors 50, 51, 52, 53, 54, 55, and 56 and the fan motors 57 and 58 transmit driving force to targets, which are about to be rotated, using plural gear trains and plural clutches.

The power supply section 7 is explained below.

The power supply section 7 is provided in a case in the machine body 1*a*. Electric power from the power supply section is supplied to a control system, a driving system, high-voltage components, and the heater 27.

The control system indicates the CPU 3 and the mechanical controller 45 of the main control section 6, motor drivers for the motors 50, 51, 52, 53, 54, 55, and 56 and the fan motors 57 and 58, and the like.

The driving system indicates the motors 50, 51, 52, 53, 54, 55, and 56 and the fan motors 57 and 58, the gears and the clutches, and control circuits for the motors.

The driving system is arranged in the machine body 1*a* and drives the fan motors for all the fans, which need to operate for cooling during the electricity saving mode, and the motor drivers. In some case, a fan configured to cool a discharged sheet is provided in the paper discharge section 25. This fan is also included in the driving system.

The driving system also has a function for detecting opening and closing of a body cover of the machine body 1*a*. The relay switch section 70 operates in association with the opening and closing of the body cover of the machine body 1*a*. When the body cover is opened, the relay switch section 70 stops the operation of the driving system such that a danger to a person does not occur.

The high-voltage components indicate the developing device 18, the charger 17, a charger for the transfer device, and the like.

The power supply section 7 includes a rectifying circuit 38, a low-voltage power supply section 8, a high-voltage power supply section 39, an electricity storing section 9, a stored-electricity monitoring section (a monitoring section) 43, and a changeover switch section (a path switching section) 10.

The rectifying circuit 38 rectifies an AC (Alternating Current) voltage from a commercial AC power supply (a commercial power supply) 41 and outputs a DC (Direct Current) voltage. The rectifying circuit 38 includes a power transistor and a capacitor.

The low-voltage power supply section 8 generates voltage for circuits for supplying electric power to the electronic circuits and voltage for motors for supplying electric power to the motors 50, 51, 52, 53, 54, 55, and 56 and the fan motors 57 and 58 and outputs the voltages.

The voltage for circuits indicates, for example, 5V, 3.3V, or ±12 V. The voltage for motors indicates, for example, 24 V.

Figure 3:
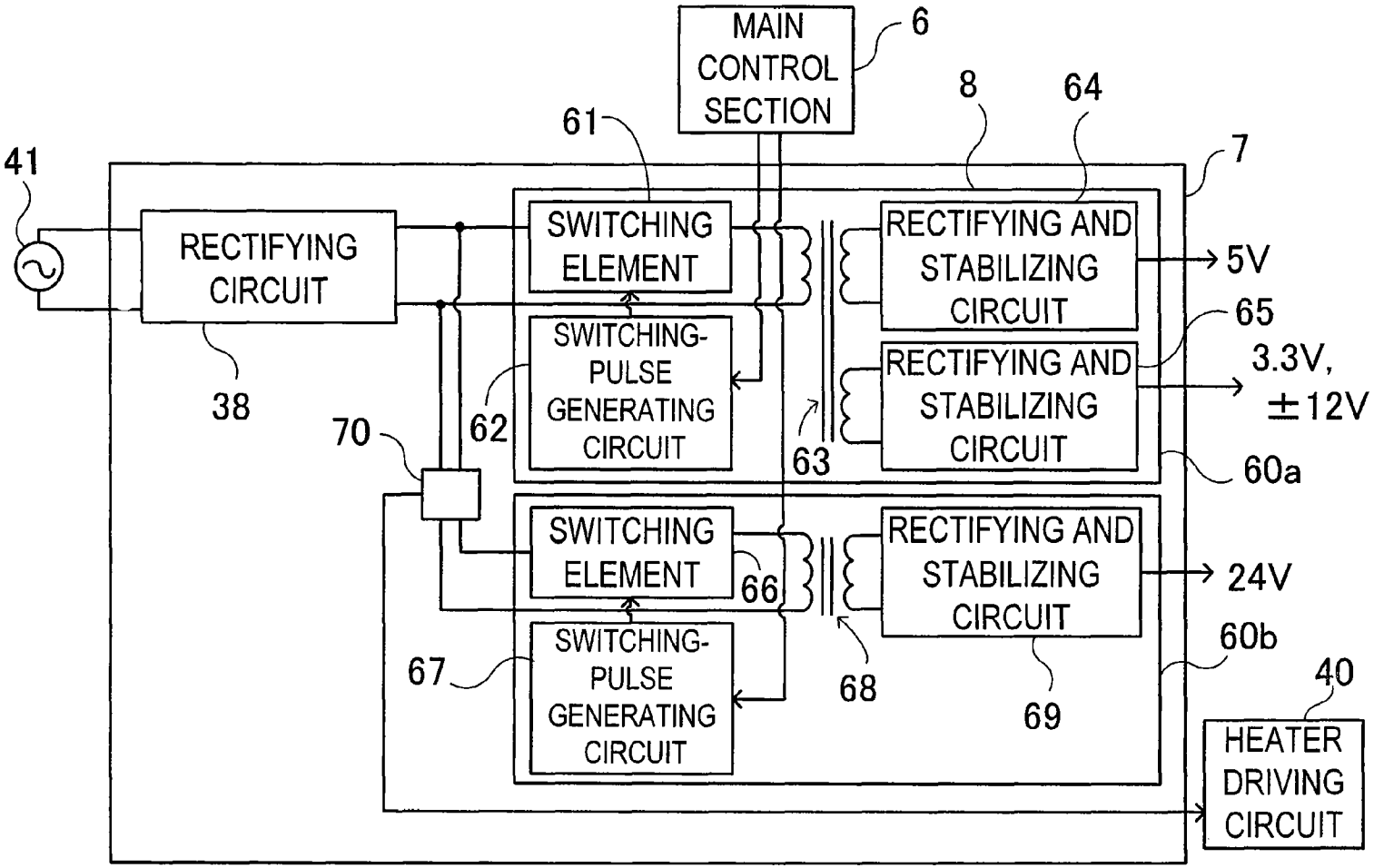
FIG. 3 is a diagram of a configuration example of a low-voltage power supply section.

FIG. 3 is a diagram of a configuration example of the low-voltage power supply section 8. In the figure, a part of the power supply section 7 is shown besides the low-voltage power supply section 8. Components same as those explained above are denoted by the same reference numerals and signs.

The low-voltage power supply section 8 includes an AC-to-DC conversion circuit for control (a first power system) 60*a* and an AC-to-DC conversion circuit for driving (a second power system) 60*b*.

The AC-to-DC conversion circuit for control 60*a* includes a switching element 61, a switching-pulse generating circuit 62, a transformer 63, rectifying and stabilizing circuits (rectifying and stabilizing circuits) 64 and 65.

An FET (Field-Effect Transistor) is used as the switching element 61. The switching-pulse generating circuit 62 generates a switching pulse having a switching frequency.

The switching element 61 is turned on and off according to a switching frequency to thereby convert a DC voltage from the rectifying circuit 38 into a pulse-like AC voltage.

The transformer 63 transforms the AC voltage and outputs a different AC voltage. The rectifying and stabilizing circuits 64 and 65 convert the pulse-like AC voltage into a DC voltage. DC power obtained in this way is supplied to the electronic circuits and the like.

The AC-to-DC conversion circuit for driving 60*b* includes a switching element 66, a switching-pulse generating circuit 67, a transformer 68, and a rectifying and stabilizing circuit 69.

The switching element 66 is turned on and off by the switching-pulse generating circuit 67. The switching element 66 converts a DC voltage from the rectifying circuit 38 into a pulse-like AC voltage.

The transformer 68 transforms the AC voltage and outputs a different AC voltage. The rectifying and stabilizing circuit 69 converts the pulse-like AC voltage into a DC voltage of about 24 V. DC power obtained in this way is supplied to the motors.

The switching-pulse generating circuits 62 and 67 are oscillators.

Referring back to FIG. 1, the high-voltage power supply section 39 supplies a high voltage to the developing device 18, the charger 17, and the charger of the transfer device. The high voltage indicates a voltage of several hundred volts to several kilovolts.

A DC-to-DC converter is used for the high-voltage power supply section 39. A DC voltage is supplied to the high-voltage power supply section 39 by the AC-to-DC conversion circuit for control 60*a* or the AC-to-DC conversion circuit for driving 60*b* in the low-voltage power supply section 8. The high-voltage power supply section 39 generates a high voltage supplied to the chargers.

The electricity storing section 9 is a chargeable and dischargeable battery. An electric double layer capacitor is used as the electricity storing section 9.

The electric double layer indicates a state in which, when two different phases such as solid and liquid come into contact with each other, plus and minus charges are present in an interface of the phases a distance at a molecular level apart from each other. The electric double layer capacitor is a capacitor configured to cause the electric double layer to function as a dielectric.

Figure 4A:
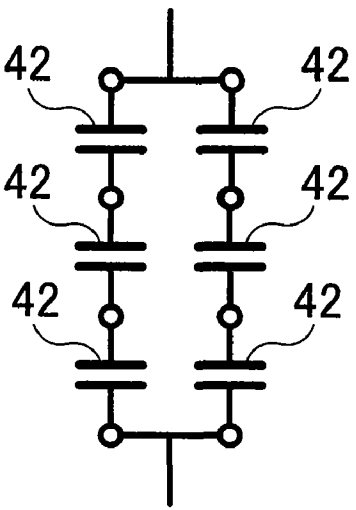
FIGS. 4A to 4C are diagrams of configuration examples of an electricity storing section.
Figure 4B:
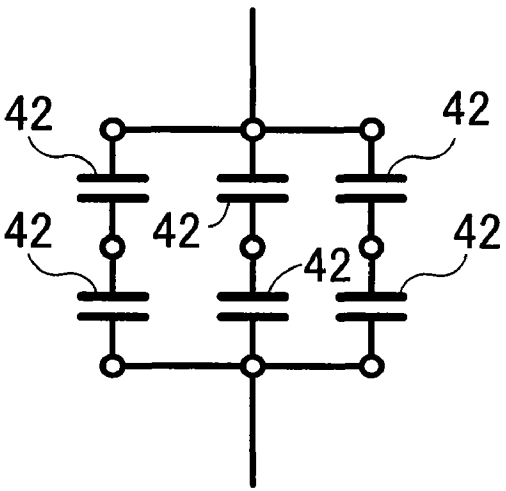
Figure 4C:
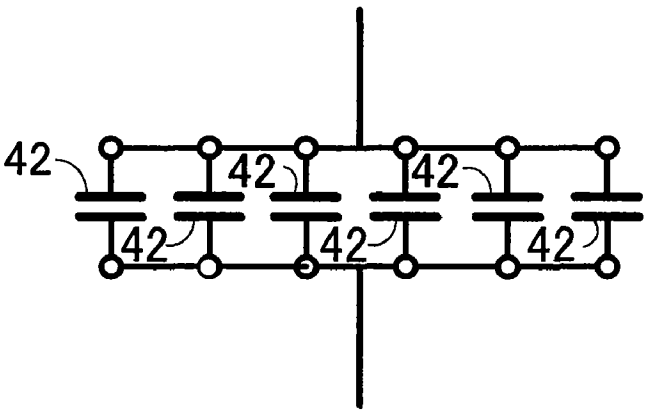

FIGS. 4A to 4C are diagrams of configuration examples of the electricity storing section 9. In the examples shown in the figures, the electric double layer capacitor is used as the electricity storing section 9. The electricity storing section 9 is configured by connecting plural capacitor cells 42.

The capacitor cells 42 are characterized by having small internal resistance, being chargeable and dischargeable in a short time, and having a low terminal voltage.

As shown in FIG. 4A, the electricity storing section 9 is configured by connecting, in parallel, two batteries each including three capacitor cells 42 connected in series. When the voltage of the capacitor cell 42 is set to 1 V, the output voltage of the electricity storing section 9 is 3 V. The plural capacitor cells 42 configure one capacitor block.

Alternatively, as shown in FIG. 4B, the electricity storing section 9 may be configured by connecting, in parallel, three batteries each including two capacitor cells 42 connected in series. In this case, the output voltage of the electricity storing section 9 is 2 V.

Alternatively, as shown in FIG. 4C, the electricity storing section 9 may be configured by connecting, in parallel, six batteries each including one capacitor cell 42 connected in series. In this case, the output voltage of the electricity storing section 9 is 1 V.

The stored-electricity monitoring section 43 shown in FIG. 1 monitors the remaining electric energy of the electricity storing section 9.

When an electricity storing device 9*a* is a capacitor having a large capacity such as the electric double layer capacitor, the stored-electricity monitoring section 43 measures the terminal voltage of the electricity storing device 9*a*. The stored-electricity monitoring section 43 is allowed to detect stored electricity of the electricity storing section 9 by measuring the terminal voltage.

The stored-electricity monitoring section 43 outputs information indicating the stored electricity stored in the electricity storing section 9. The information indicates a stored electricity signal readable by the CPU 3.

A chargeable and dischargeable lithium ion secondary cell may be used as the electricity storing device 9*a*. As the electricity storing section 9, a battery pack including plural lithium ion secondary cells connected in series and in parallel is used. The lithium ion secondary cell is characterized by having high energy density.

When the electricity storing device 9*a* is the battery pack of the lithium ion secondary cells, the stored-electricity monitoring section 43 monitors charged electricity and discharged electricity using a Coulomb counter or the like.

The changeover switch section 10 supplies, according to a control signal from the main control section 6, electric power from one of the low-voltage power supply section 8 and the electricity storing section 9 to the driving system. For example, a relay switch is used as the changeover switch section 10.

The changeover switch section 10 is a path switching section. In the power saving modes, the changeover switch section 10 switches a supply path for electric power to interrupt the electric power from the AC-to-DC conversion circuit 60*b* to the fan 36 and the like and supply electric power from the electricity storing section 9 to the fan 36 and the like.

The changeover switch section 10 includes a terminal driven to be turned on and off, a contact q connected to a secondary side circuit, a first contact r connected to the low-voltage power supply section 8, and a second contact s connected to the electricity storing section 9. The secondary side circuit indicates electric components in the machine body 1*a*.

When a terminal output is off, the changeover switch section 10 connects the contact r and the contact q and opens the contact s. Electric power from the low-voltage power supply section 8 is supplied to the secondary side circuit.

When the terminal output is on, the changeover switch section 10 connects the contact s and the contact q and opens the contact r. Electric power from the electricity storing section 9 is supplied to the secondary side circuit.

While the terminal output is off, the changeover switch section 10 retains states of the contacts q, r, and s. Retaining force is mechanical force or electromagnetic force.

When the terminal output is switched from on to off, the changeover switch section 10 switches the contacts q, r, and in an ON state to the contacts q, r, and s in an OFF state.

A power supply configuration for power saving in the electricity saving mode is explained below with reference to FIG. 5.

Figure 5:
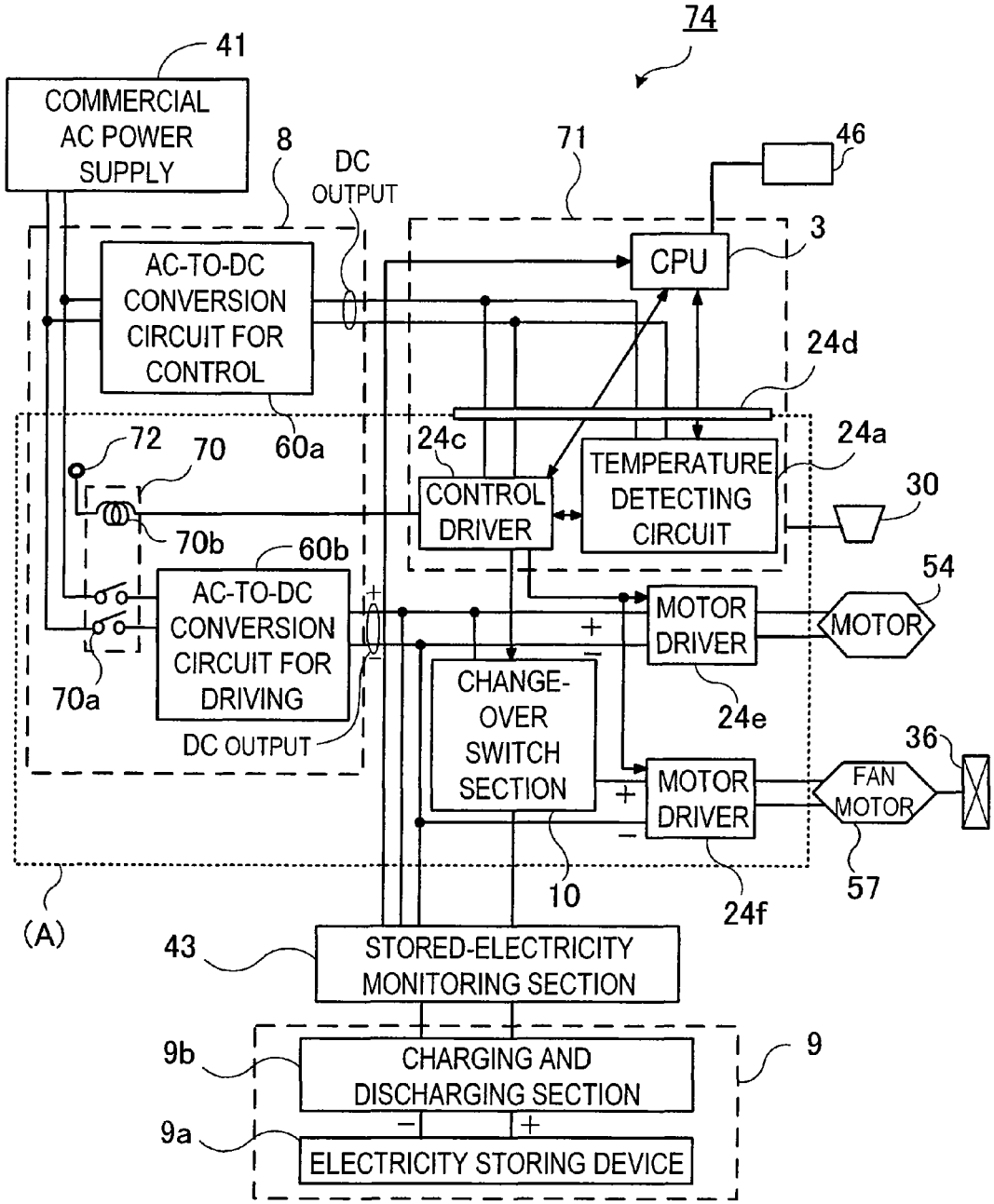
FIG. 5 is a functional block diagram focused on a power switching control function.

FIG. 5 is a functional block diagram focused on a power switching control function. The power supply unit 74 is shown in the figure. The power supply unit 74 supplies necessary electric power to the color copying machine 1. Components same as those explained above are denoted by the same reference numerals and signs.

The relay switch section (a switch) 70 is provided in an input section of the AC-to-DC conversion circuit for driving 60*b*. The relay switch section 70 turns on and off electric power from the commercial AC power supply 41 to the AC-to-DC conversion circuit for driving 60*b* in association with open and close of the body cover.

While the body cover is closed, the relay switch section 70 supplies DC voltage to the control driver 24*c*. An AC relay attached with an electromagnetic coil is used as the relay switch section 70. The relay switch section 70 includes the coil 70*a* and a switch 70*b*.

The coil 70*a* is an excitation coil. A terminal 72 of the coil 70*a* is connected to an open and close switch provided on the rear surface of the body cover.

The coil 70*a* also functions as a second power system. The coil 70*a* supplies electric power, which is supplied from the commercial AC power supply 41, to the driving system provided in the color copying machine 1.

The switch 70*b* is an AC relay. The switch 70*b* opens a circuit when electric power is given from the coil 70*a* and closes the circuit when electric power is not given. The circuit indicates a connection point between the commercial AC power supply 41 and the AC-to-DC conversion circuit for driving 60*b* in the low-voltage power supply section 8.

When the body cover is closed, the coil 70*a* is turned on. The coil 70*a* feeds a DC current obtained by removing an AC component to the control driver 24*c*. The coil 70*a* opens the switch 70*b* with electromagnetic force of an AC current. DC power obtained by converting AC power of the commercial AC power supply 41 is supplied to the secondary side circuit, i.e., an output side circuit of the low-voltage power supply section 8.

When the body cover is opened, the coil 70*a* is turned off. The AC power of the commercial AC power supply 41 is not supplied to the secondary side circuit. The coil 70*a* releases the switch 70*b* and closes the switch 70*b*. The DC power obtained by converting the AC power of the commercial AC power supply 41 is supplied to the secondary side circuit.

In FIG. 5, the power supply unit 74 divides electric power supplied from the commercial AC power supply 41 into two, i.e., electric power to the control system and electric power to the driving system. A control circuit section 71 is configured on the secondary side of the control system.

The control circuit 71 causes the CPU (the first control circuit) 3 to interrupt power supply to the motor driver 24*f* via the control driver 24*c*. Components to which the supply of electric power should be cut off in the electricity saving mode are configured to be disconnected.

The control circuit section 71 includes the control driver 24*c* connected to the coil 70*a*, the temperature detecting circuit 24*a*, and the CPU 3. The control circuit section 71 includes the interface section 24*d*.

The CPU 3 configured to manage control, the control driver 24*c*, and sensors for temperature monitoring and the like are connected to the AC-to-DC conversion circuit for control 60*a*.

Loads such as the motor driver 24*e* for the motor 54 and the motor driver 24*f* for the fan motor 57 are connected to the driving system. In the power supply unit 74, the relay switch section 70 is arranged in an input section of the driving system.

The relay switch section 70 is allowed to interrupt the supply of an AC component in order to reduce a loss of power consumption in the AC-to-DC conversion circuit for driving 60*b*.

The AC-to-DC conversion circuit for driving 60*b* of the low-voltage power supply section 8 divides electric power from the electricity storing section 9. In the power supply unit 74, the stored-electricity monitoring section 43 is provided between the AC-to-DC conversion circuit for driving 60*b* and the electricity storing section 9.

The electricity storing section 9 includes the electricity storing device 9*a*, plus and minus two electrodes of which are exposed, and a charging and discharging section 9*b* configured to charge and discharge the electricity storing device 9*a*.

A capacity of the electricity storing device 9*a* for storing electricity is high. The charging and discharging section 9*b* turns on and off charging and turns on and off discharging. The charging and discharging section 9*b* includes a DC-to-DC converter for charging and a resistor for discharging.

The power supply unit 74 switches, with the changeover switch section 10, the supply of electric power from the low-voltage power supply section 8 to the fan motor 57 and the supply of electric power from the electricity storing section 9 to the fan motor 57.

During the copy mode, the electricity storing section 9 is charged by electric power of the AC-to-DC conversion circuit for driving 60*b*.

When electric power of the commercial AC power supply 41 is input to the rectifying circuit 38 of the color copying machine 1 (FIG. 1) having the configuration explained above, the main control section 6 causes the temperature of the fixing device 23 to reach fixable temperature.

Operation modes of the color copying machine 1 include a copy mode, a ready mode, an electricity saving mode, and a sleep mode. The copy mode is a normal mode in which the color copying machine 1 operates with normal power consumption.

All of the ready mode, the electricity saving mode, and the sleep mode are power saving modes. The power saving modes indicate modes in which the color copying machine 1 operates with electric power lower than the power consumption in the normal mode.

When an original document is inserted into the color copying machine 1, the main control section 6 causes the laser exposing device 22 to generate a laser beam corresponding to the intensity of image data.

In the image forming station 14Y, the photoconductive drum 16 is rotated in an arrow direction and uniformly charged to about −700 V by the charger 17.

The laser exposing device 22 irradiates the laser beam modulated according to image information read by the scanner section 2 on the photoconductive drum 16. An electrostatic latent image is formed on a drum surface of the photoconductive drum 16.

A bias of about −500 V is applied to the developing device 18. A toner is supplied to the photoconductive drum 16 by the developing device 18. A yellow toner image is formed on the drum surface of the photoconductive drum 16.

The transfer roller 19 applies a bias of about +1000 V to a transfer position opposed to the photoconductive drum 16 on the outer circumferential surface of the belt 13. In the transfer position, the yellow toner image is transferred onto a sheet conveyed on the belt 13.

After the transfer of the yellow toner image ends, the cleaner 20 cleans a residual toner on the photoconductive drum 16. The charge removing device 21 removes charges on the surface of the photoconductive drum 16.

Magenta, cyan, and black toner images are sequentially transferred, in transfer positions for the toner images, onto the sheet on which the yellow toner image is formed. The sheet on which the color toner images are formed is sent to a nip of the fixing device 23.

The press roller 29, in conjunction with the heat roller 28, heats and presses the sheet and fixes the color toner images on the sheet. A full-color image is completed on the sheet. The sheet is discharged to the paper discharge section 25.

Processing applied to the fixing device 23 by the main control section 6 is explained below.

The color copying machine 1 having the configuration shown in FIG. 5 causes, in normal printing operation, the low-voltage power supply section 8 to supply electric power to the control circuit section 71, the motor drivers 24*e* and 24*f* and the like. The motor 54 and the fan motor 57 operate using the output of the AC-to-DC conversion circuit for driving 60*b* of the low-voltage power supply section 8 as a power source.

Before the color copying machine 1 is transitioned to the electricity saving mode, first, the stored-electricity monitoring section 43 detects electric energy of the electricity storing section 9. The stored-electricity monitoring section 43 notifies the CPU 3 of a result of the detection.

The CPU 3 calculates electric energy necessary for time for driving the fan 36 from an output value (temperature) of the temperature sensor 30. The ROM 46 stores therein a computer program for calculating electric energy from temperature. The computer program causes the CPU 3 to execute calculation processing. Alternatively, a correspondence relation between temperature and electric energy is stored in a memory in advance. The CPU 3 reads out the correspondence relation from the memory.

The CPU 3 compares the calculated or extracted electric energy and the electric energy of the electricity storing section 9. When sufficient electric energy is stored in the electricity storing section 9, the CPU 3 switches a source of power supply to the driving system from the low-voltage power supply section 8 to the electricity storing section 9. The CPU 3 supplies electric power for the cooling fan 36 and the like and drives the fan motor 57 and the like.

For example, the color copying machine 1 enters the electricity saving mode according to, for example, elapse of a set time.

In the electricity saving mode, the CPU 3 inputs a power-off signal to the relay switch section 70. The CPU 3 interrupts electric power supplied from the commercial AC power supply 41 to the relay switch section 70. The operation of the primary side circuit of the driving system is stopped in the electricity saving mode.

When an AC current supplied from the coil 70*a* to the terminal 72 is interrupted, the switch 70*b* in the open state closes the circuit. The AC-to-DC conversion circuit for driving 60*b* converts an AC current from the commercial AC power supply 41 and supplies the converted DC current to the secondary side circuit.

Both of the operation of the control driver 24*c* and the operation of the temperature detecting circuit 24*a* are stopped according to the interruption of the AC current to the coil 70*a*.

The CPU 3 switches the changeover switch section 10 to ON in association with the interruption of the AC current to the coil 70*a*. Electric power from the electricity storing section 9 is supplied to the motor driver 24*f* and the fan motor 57. The electricity storing section 9 supplies the electric power to the motor driver 24*e* and the motor 54.

The electricity storing section 9 may supply the electric power to fans that need to be rotated in the electricity saving mode, for example, fans for cooling process system components such as drums, chargers, and attenuators and a fan for cooling a discharged sheet.

As explained above, after the color copying machine 1 enters the electricity saving mode, the source of power supply to the driving system is switched from the low-voltage power supply section 8 to the electricity storing section 9. The electric power stored in the electricity storing section 9 can drive the motor 54, the fan motor 57, the motor driver 24*e*, the motor driver 24*f*, and the like.

Figure 6:
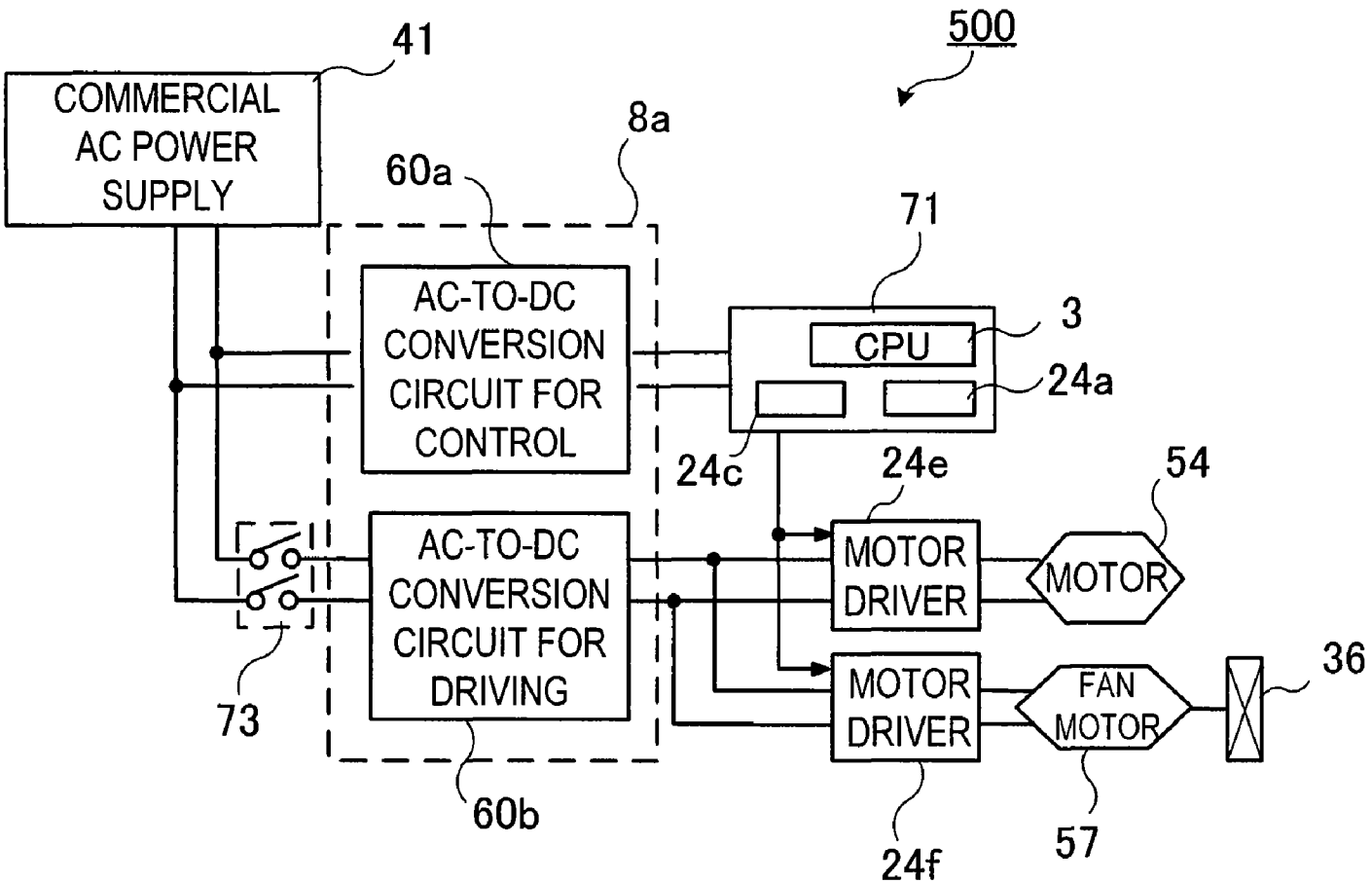
FIG. 6 Related Art
FIG. 6 is a diagram of a main part of a power supply configuration of a color copying machine according to related art.

FIG. 6 is a diagram of a main part of a power supply configuration of a color copying machine according to related art. It is assumed that types of motors that operate in the electricity saving mode of a color copying machine 500 according to the related art are the same as the types of the motors that operate in the electricity saving mode of the color copying machine 1.

Reference numeral 73 denotes an interlock switch. Reference sign 8*a* denotes a low-voltage power supply section. Other reference numerals and signs shown in the figure are the reference numerals and signs corresponding to the components in the color copying machine 1 explained above.

In the related art, when the cooling fan 36 is used, a temperature sensor is arranged in a fixing device. When a sensor output falls below predetermined temperature, a control section stops the operation of the fan motor 57.

In the electricity saving mode, the color copying machine 500 covers electric power using only the low-voltage power supply section 8*a*. On the other hand, in the electricity saving mode, the color copying machine 1 covers electric power to the motor 54 and the fan motor 57 with electric power from the electricity storing section 9.

The power supply unit 74 shown in FIG. 5 adopts a system for causing the fan 36 to operate until charges of the electricity storing section 9 is exhausted.

This makes it unnecessary for the color copying machine 1 to energize the temperature sensor 30 and the temperature detecting circuit 24*a* configured to always detect temperature in the electricity saving mode. Therefore, it is possible to reduce electric power in the circuit of the control system.

The control driver 24*c* and the temperature detecting circuit 24*a* in the control circuit section 71 are unnecessary in the electricity saving mode. It is possible to reduce loads required by the low-voltage power supply section 8 for temperature detection by interrupting energization to the control driver 24*c* and the temperature detecting circuit 24*a* that do not operate and energization to the various motor drivers for the motors in the image forming unit 12. Therefore, it is possible to reduce the primary side power consumption.

This makes it possible to reduce power consumption in the electricity saving mode by stopping the supply of electric power to the circuits in an area (A) surrounded by a dotted line in FIG. 5. Therefore, it is possible to improve energy consumption of the color copying machine 1 in the electricity saving mode.

In the electricity saving mode, it is possible to reduce power consumption of the components other than the fixing device 23. Therefore, the energy saving standards of the Energy Star Program and the like are sufficiently satisfied.

(Modification of the First Embodiment)

The example shown in FIG. 5 is an example in which it is assumed that the electricity storing section 9 is fully charged with electricity. On the other hand, in some case, sufficient electricity is not stored in the electricity storing section 9.

Before transitioning the mode to the electricity saving mode, the CPU 3 acquires detected temperature from the temperature sensor 30. The CPU 3 compares calculated or extracted electric energy and stored electricity of the electricity storing section 9.

When sufficient stored electricity is not present in the electricity storing section 9 compared with electric energy for cooling, the CPU 3 suspends switching by the changeover switch section 10 for a predetermined time. The CPU 3 suspends the switching until a point in time when it is possible to lower the temperature of the heater 27 to target temperature using remaining stored electricity comes.

The CPU 3 estimates time in which it is possible to continue to drive the fan motor 57 by exhausting the remaining stored electricity.

The CPU 3 keeps the temperature detecting circuit 24*a* operating. The CPU 3 continues to monitor the output of the temperature detecting circuit 24*a*.

The CPU 3 determines, by comparing the detected temperature of the temperature sensor 30 and the remaining stored electricity, whether it is possible to lower the temperature of the heater 27 from the temperature of the heater 27 at the present point in time to the target temperature. The CPU 3 executes the determination processing at plural points of time.

The CPU 3 supplies the electric power from the low-voltage power supply section 8 to the motor driver 24*f*, the fan motor 57, and the like and causes the fan 36 to operate until a point in time comes.

Thereafter, the CPU 3 detects that a point in time when it is sufficiently possible to lower the temperature of the heater 27 to the target temperature comes.

At the point in time, the CPU 3 switches a supply source of electric power from the low-voltage power supply section 8 to the electricity storing section 9. The output of the low-voltage power supply section 8 stops simultaneously with the switching.

The fan motor 57 starts driving with the remaining stored electricity at the point in time. The fan 36 operates until the remaining stored electricity is exhausted.

In the color copying machine 1 proposed in the first embodiment, the circuit (the changeover switch section 10) including the electricity storing device 9*a* is configured in the driving system circuit section, the fan 36 is caused to operate by the electric power supplied from the electricity storing device 9*a*, and the power supply from the low-voltage power supply section 8 to the fan 36 is interrupted.

The example in the past and the color copying machine 1 in the electricity saving mode are compared. The color copying machine 500 supplies the electric power from the AC-to-DC conversion circuit for driving 60*b* to the fan 36. On the other hand, the proposed color copying machine 1 switches, such that the electric power is supplied from the electricity storing device 9*a*, the power supply source to cause the fan 36 and the like to operate.

It is possible to eliminate a loss of power consumption in the driving system circuit by interrupting the AC-to-DC conversion circuit for driving 60*b* with the switch 70*a* or the like. As a result, it is possible to reduce power consumption of the primary side circuit.

When the mode is transitioned to the electricity saving mode, the control circuit section 71 stops the fan 36 according to discharge of the electricity storing device 9*a* without temperature detection by the main control section 6. By adopting such a configuration, it is possible to stop power supply to the temperature detecting circuit 24*a* and the temperature sensor 30 and reduce power consumption.

(Second Embodiment)

In the first embodiment, in some case, stored electricity of the electricity storing section 9 is sufficiently large compared with the electric energy for cooling. For example, when the electricity storing section 9 has stored electricity for rotating the fan 36 for ten minutes, in some case, the heater 27 can be cooled simply by continuing to rotate all the fans for, for example, three minutes. However, it is waste of electric power to drive all the fans for seven minutes.

An image forming apparatus according to a second embodiment divides the electric power of the electricity storing section 9 into plural kinds of electric power and use the divided kinds of electric power. The image forming apparatus determines stored electricity corresponding to the electric energy for cooling, causes a determined electricity storing device to operate, and cools a fan motor.

The image forming apparatus according to the second embodiment is also a color copying machine. Reference numeral 200 in FIG. 1 denotes the color copying machine.

The color copying machine 200 includes the machine body 1*a*, the scanner section 2, the image processing section 44, the printer section 4, the paper feeding section 5, a main control section 201, and a power supply section 202.

In the color copying machine 200, all of the machine body 1*a*, the scanner section 2, the image processing section 44, the printer section 4, and the paper feeding section 5 are substantially the same as those of the example in the first embodiment.

The power supply section 202 includes another electricity storing section 203 different from the electricity storing section 9. An electric double layer capacitor is used as the electricity storing section 203. The electricity storing section 203 includes plural capacitor blocks.

Figure 7:
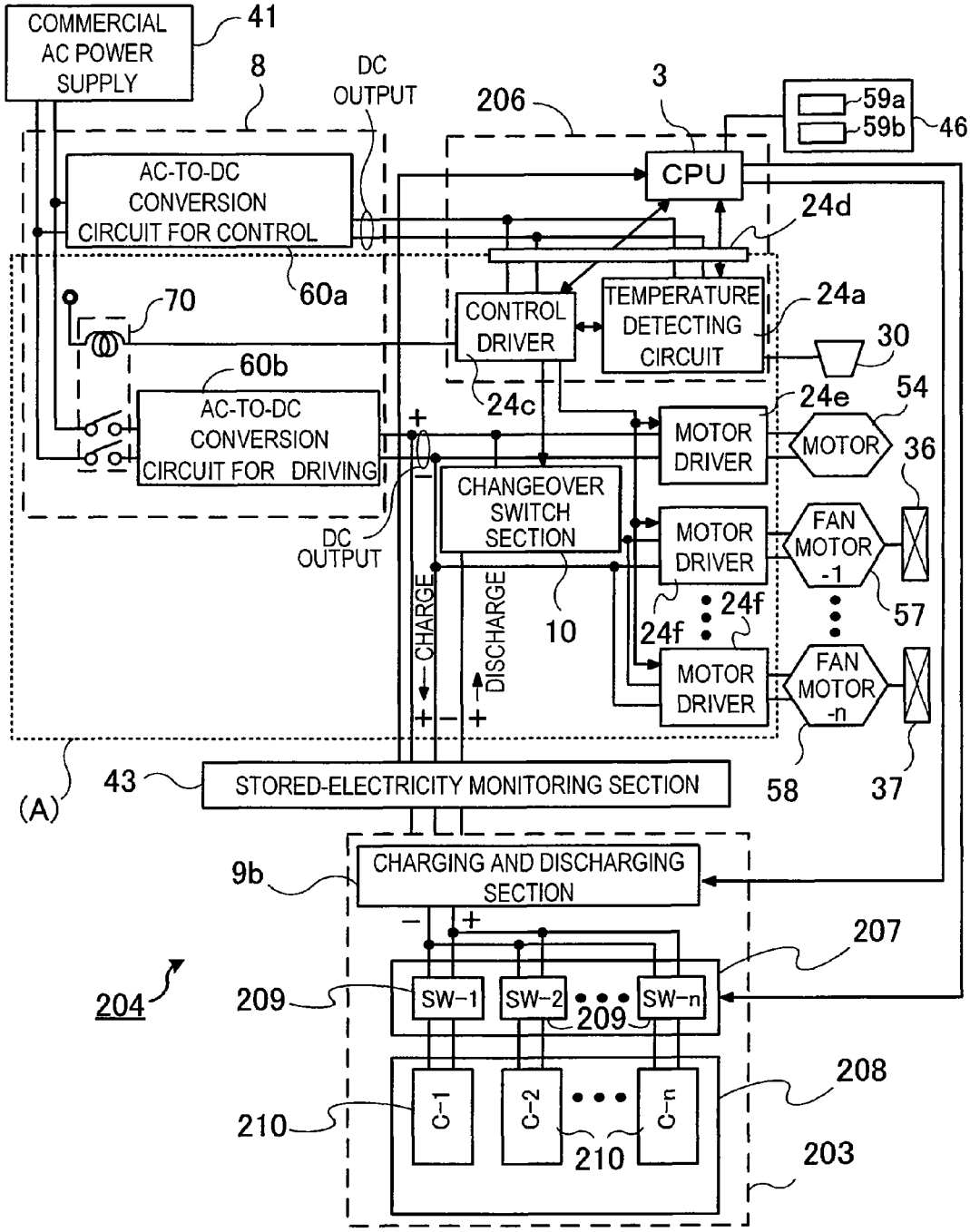
FIG. 7 is a functional block diagram focused on a power switching control function used for an image forming apparatus according to a second embodiment.

FIG. 7 is a functional block diagram focused on a power switching control function used for the image forming apparatus according to the second embodiment. Components same as those explained above are denoted by the same reference numerals.

The CPU 3 functions as a first control circuit.

A power supply unit 204 causes the CPU 3 to interrupt power supply to the motor driver 24*f* via the control driver 24*c*. The power supply unit 204 includes a power supply of a power saving configuration and is provided in the color copying machine 200.

An area (A) surrounded by a dotted line indicates an area in which the supply of electric power from the low-voltage power supply section 8 is turned off in the electricity saving mode.

The electricity storing section 203 includes the charging and discharging section 9*b*, a discharge switch section 207, and an electricity storing device 208.

The discharge switch section 207 includes plural switching elements 209 (SW-1, . . . , and SW-n) (n represents a natural number). All the switching elements 209 are driven to be turned on and off by the CPU 3. As the switching elements 209, IGBTs (Insulated Gate Bipolar Transistors) or the like are used.

The electricity storing device 208 includes plural capacitor blocks 210 (C-1, C-2, . . . , and C-n). Each of the capacitor blocks 210 includes the plural capacitor cells 42 (FIGS. 4A to 4C).

One switching element 209 is provided between the charging and discharging section 9*b* and one capacitor block 210.

The switching element 209 is in an OFF state until the supply of electric power from the capacitor block 210 to the charging and discharging section 9*b* is instructed by the CPU 3. In the off state, the switching element 209 opens the capacitor block 210 and the charging and discharging section 9*b*. The capacitor block 210 is kept opened.

After the supply of electric power from the capacitor block 210 to the charging and discharging section 9*b* is instructed, the switching element 209 changes to an ON state. In the ON state, the switching element 209 closes the capacitor block 210 and the charging and discharging section 9*b*. The capacitor block 210 discharges using the charging and discharging section 9*b* as a load.

The switching element 209 and all the other switching elements 209 are the same. The switching elements 209 are provided in parallel to one another.

During the copy mode, the electricity storing section 203 is charged by electric power of the AC-to-DC conversion circuit for driving 60*b*.

As shown in FIGS. 1 and 7, the power supply unit 204 divides electric power supplied from the commercial AC power supply 41 into two, i.e., electric power to the control system and electric power to the driving system in the low-voltage power supply section 8. A control circuit section 206 is configured on the secondary side of the control system.

The ROM 46 stores therein two kinds of tables (lookup tables) 59*a* and 59*b*. The tables 59*a* and 59*b* are generated in the ROM 46 in advance. The CPU 3 estimates, referring to the tables 59*a* and 59*b*, a cooling time from detected temperature of the temperature sensor 30 using table data.

The electricity storing section 203 is connected to the AC-to-DC conversion circuit for driving 60*b* of the low-voltage power supply section 8.

In the power supply unit 204, the charging and discharging section 9*b* that charges and discharges is arranged in the electricity storing section 203. In the power supply unit 204, the switching elements 209 are respectively arranged in the capacitor blocks 210. Charging and discharging can be set for each of the capacitor blocks 210. The CPU 3 manages on and off of the switching elements 209.

In the power supply unit 204, the stored-electricity monitoring section 43 is provided in an input and output terminal section of the electricity storing section 203. The stored-electricity monitoring section 43 detects charged electricity and discharged electricity of the entire electricity storing section 203 and detects the voltage at an output terminal of the electricity storing section 203.

The power supply unit 204 is allowed to always monitor stored electricity by detecting the charged electricity and the discharged electricity and the voltage. The stored-electricity monitoring section 43 notifies a result of the detection to the CPU 3 according to communication between the stored-electricity monitoring section 43 and the CPU 3. The CPU 3 is allowed to grasp a result of the stored electricity according to the communication.

Further, in the power supply unit 204, the changeover switch section 10 is arranged between the electricity storing section 203 and the low-voltage power supply section 8. The power supply unit 204 switches the supply of electric power from the low-voltage power supply section 8 to the fan motor 57 and the supply of electric power from the electricity storing section 203 to the fan motor 57.

An estimation operation for time required for cooling by the CPU 3 in the electricity saving mode and a determination operation for electric power that should be discharged by the electricity storing section 203 are explained below with reference to FIGS. 8A and 8B.

Figure 8A:
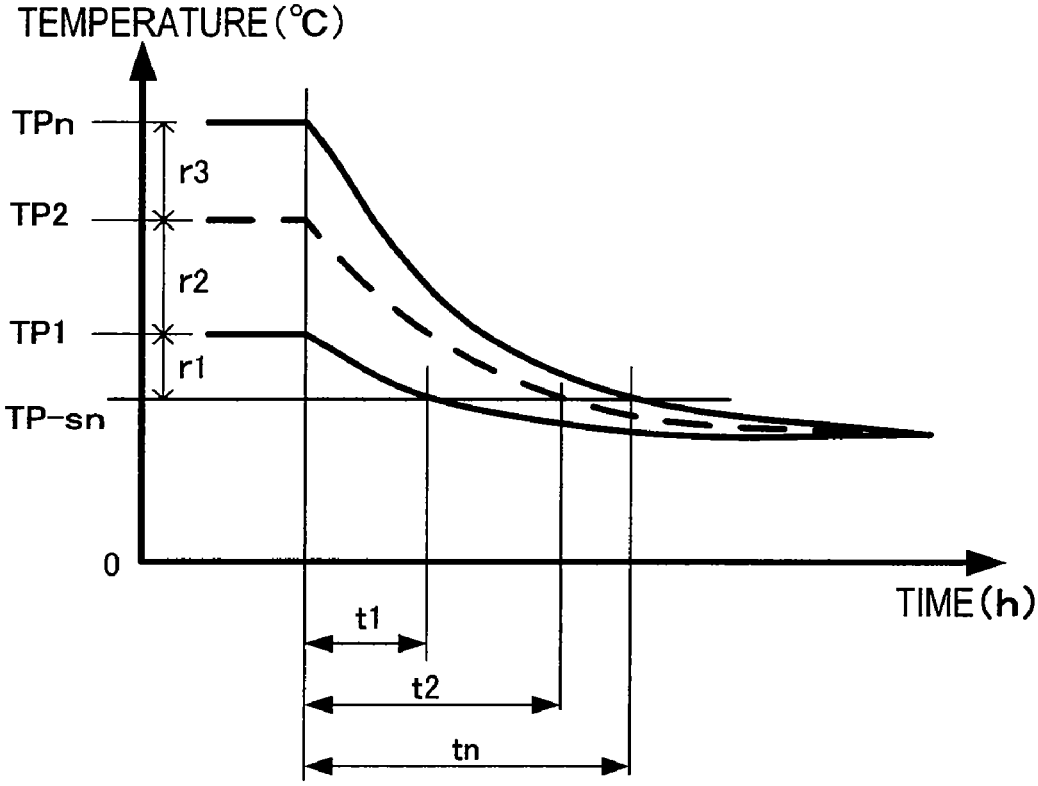
FIG. 8A is a graph of characteristics of temperature and a cooling time.

FIG. 8A is a graph of characteristics of temperature and a cooling time. The abscissa represents time (h) required for cooling. The unit of temperature is Celsius but may be Fahrenheit. All temperatures TPn, TP2, and TP1 represent temperatures detected by the temperature sensor 30 before the color copying machine 200 enters the electricity saving mode. Temperature TP-sn is a target temperature of the color copying machine 200.

In FIG. 8A, a relation that time required for lowering the temperature TPn of the color copying machine 200 to the target temperature. TP-sn is tn is shown. For example, a relation that time t1 is required to lower machine temperature from the temperature TP1 to the target temperature TP-sn is written in the first table 59*a* in advance.

Plural ranges of detected temperature are set. The table 59*a* stores a relation in which a cooling time is associated with each of the detected temperature ranges. The cooling time indicates a driving time of the fan motor 57.

As shown in FIG. 8A, the table 59*a* stores three kinds of cooling times t1, t2, and tn. The table 59*a* stores detected temperature ranges r1, r2, and r3 for the respective cooling times t1, t2, and tn. The CPU 3 selects the detected temperature ranges r1, r2, and r3 from values of detected temperature and determines any one of the cooling times t1, t2, and tn.

By referring to the table 59*a*, when the detected temperature is within the range r3 of TP2 to TPn, the CPU 3 determines the cooling time as tn. During the cooling time tn, the CPU 3 drives the fan motor 57. During the cooling time tn, the CPU 3 continues the driving without using detected temperature from the temperature sensor 30.

When the detected temperature is within the range r2 of TP1 to TP2, the CPU 3 determines the cooling time as t2. When the detected temperature is within the range r1 of TP-sn to TP1, the CPU 3 determines the cooling time as t1.

Values of the temperatures t1 and t2 and the target temperature TP-sn are determined in advance from a quantity of fan wind. The values are determined through experiments and tests.

Alternatively, the table 59*a* can also store a relation in which the cooling time (second) is associated with every 1° C. of the detected temperatures.

Figure 8B:
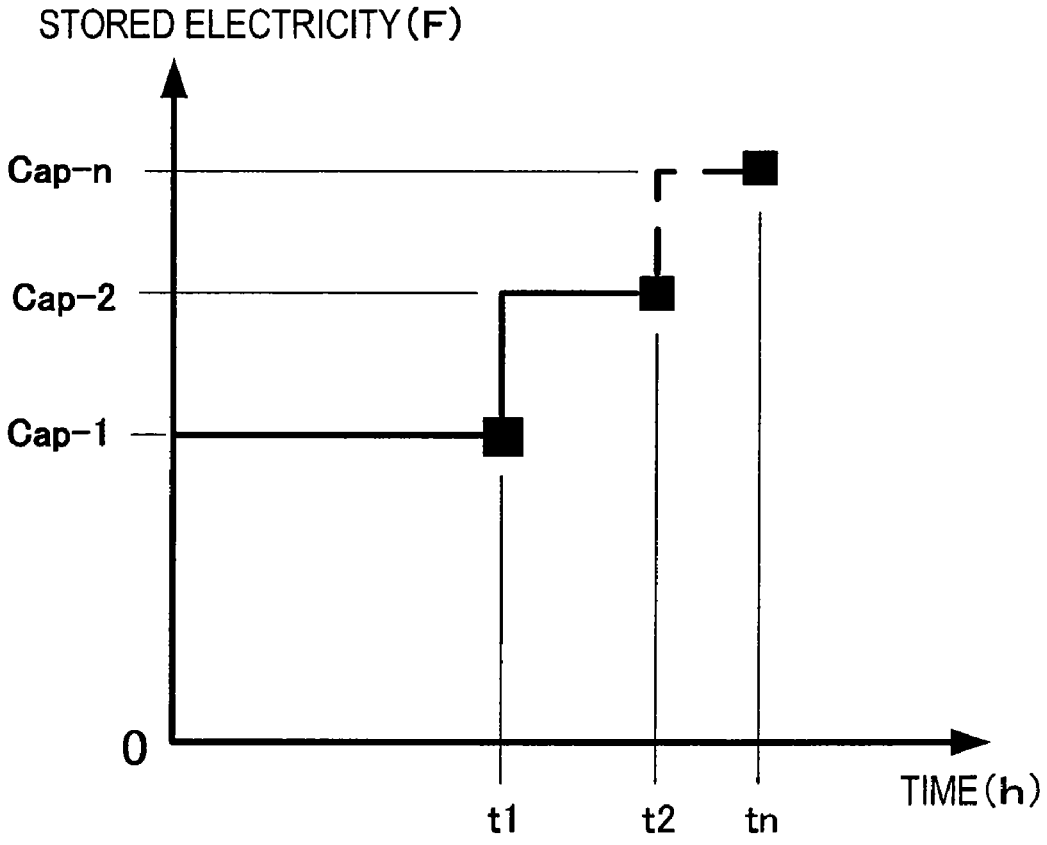
FIG. 8B is a graph of characteristics of stored electricity and a discharge time.

Characteristics stored in the second table 59*b* are shown in FIG. 8B. FIG. 8B is a graph of characteristics of stored electricity and a discharge time. The abscissa represents time (h) required for complete discharge. The time (h) is the same as the time (h) shown in FIG. BA. The ordinate represents stored electricity (F).

In the following explanation, in some case, the capacitor blocks 210 are respectively referred to as capacitor blocks C-1, C-2, . . . , and C-n.

Stored electricities Cap-1, Cap-2, . . . , and Cap-n respectively represent charged amounts of the capacitor blocks C-1, C-2, . . . , and C-n. The charged amount indicates time necessary for completely discharging one capacitor block.

The numbers of capacitor cells 42 respectively included in the capacitor blocks C-1, C-2, . . . , and C-n may be the same or may be different.

For example, a relation that time t1 is required to completely discharge the capacitor block C-1 and time t2 is required to completely discharge the capacitor block C-2 is written in the table 59*b* in advance.

Plural ranges of stored electricity are set. The table 59*b* stores a relation in which stored electricity is associated with each of cooling time ranges. The table 59*b* stores the stored electricities Cap-1, Cap-2, and Cap-n respectively for three kinds of cooling times t1, t2, and tn.

Alternatively, the table 59*b* can store a relation in which the stored electricity (F) is associated with each cooling time 1 (h).

In the power saving modes, the control driver 24*c* calculates, according to detected temperature output from the temperature detecting circuit 24*a*, necessary electric energy for time for continuing the driving of the fans 36 and 37 (cooling fan driving time).

The control driver 24*c* designates, according to a monitoring result of the stored-electricity monitoring section 43, the capacitor block 210 necessary for supplying electric power from the electricity storing section 203. The control driver 24*c* instructs the designated capacitor block 210 to supply electric power to the fans 36 and 37.

Thereafter, the control driver 24*c* causes the changeover switch section 10 to switch a supply path for electric power to the fans 36 and 37.

The operation in the electricity saving mode of the color copying machine 200 having the configuration explained above is explained below with reference to FIGS. 7, 8A, 8B, and 9.

In the normal printing operation, the color copying machine 200 supplies electric power to the control circuit section 206 and the driving system from the low-voltage power supply section 8. Both of the motor 54 and the fan motors 57 and 58 use an output to the driving system by the low-voltage power supply section 8 as a power source.

Figure 9:
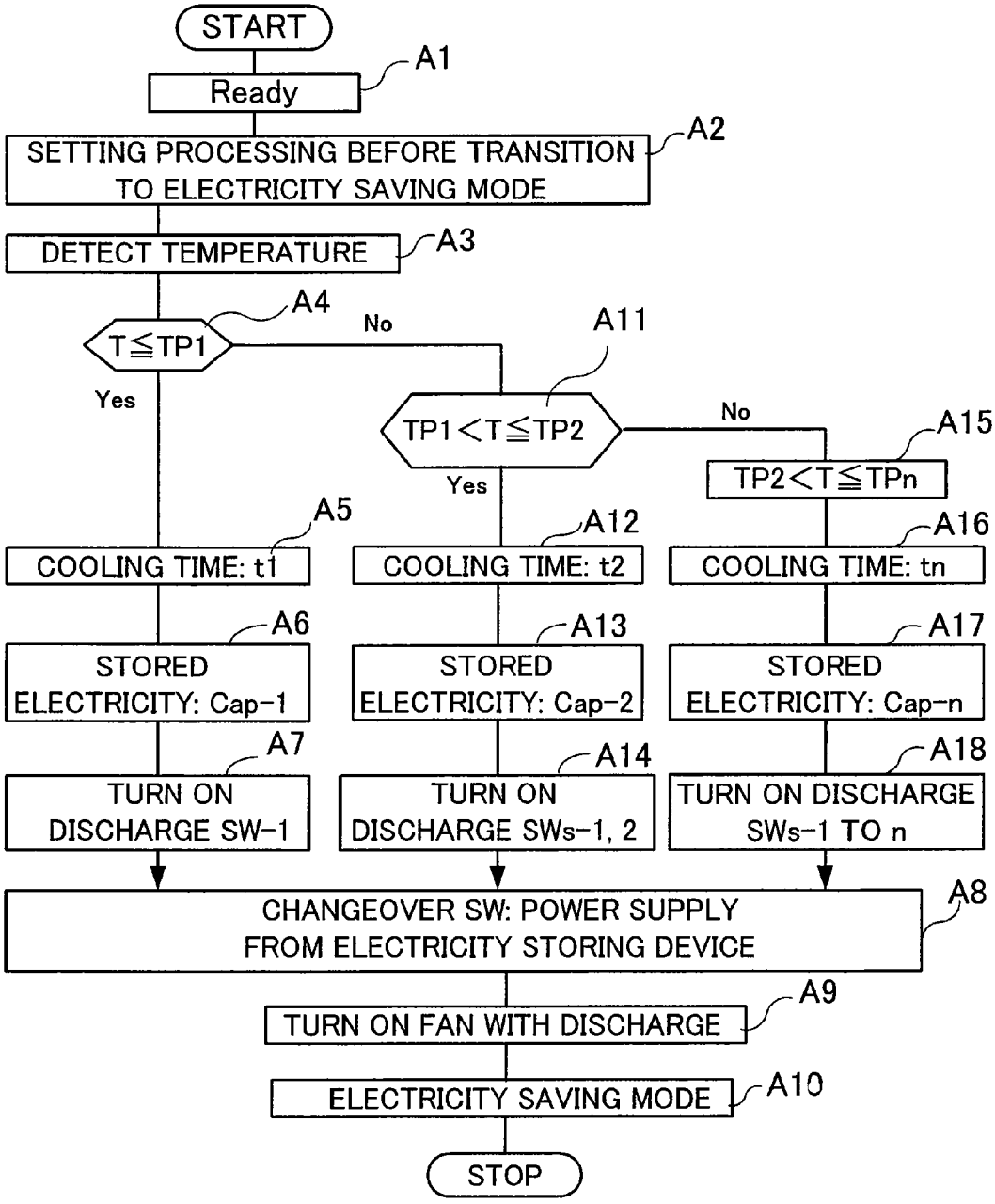
FIG. 9 is a flowchart for explaining power supply switching processing by a first control circuit in an electricity saving mode.

FIG. 9 is a flowchart for explaining power supply switching processing by the CPU 3 in the electricity saving mode. In an example explained below, it is assumed that the electricity storing section 203 is fully charged.

In Act A1, after printing ends, the CPU 3 transitions the machine mode to the ready mode. In Act A2, after a set time elapses, the CPU 3 starts setting before transitioning to the electricity saving mode.

In Act A3, the CPU 3 detects the temperature of a cooling target component using the temperature sensor 30.

In Act A4, the CPU 3 determines whether the detected temperature T is equal to or lower than, for example, the first temperature TP1. If a detection result is affirmative (Yes in Act A4), in Act A5, the CPU 3 sets a cooling time to t1.

In Act A6, the CPU 3 estimates, using the relation of the characteristic graph (FIG. 8B), electric energy for causing the fan 36 to operate for the time t1 and determines the electric energy as discharged electricity Cap-1 from the electricity storing device 208.

At the same time, the CPU 3 confirms that stored electricity at that point notified from the stored-electricity monitoring section 43 satisfies the discharged electricity Cap-1.

In Act A7, after determining this discharged electricity, the CPU 3 selects and turns on all or a part of the plural switching elements 209 connected to the capacitor blocks 210.

The number of selected switching elements 209 corresponds to the discharged electricity Cap-1. The CPU 3 selects one or plural switching elements 209 according to the discharged electricity Cap-1. The components of the electricity storing section 203 are finely divided to allow the electricity storing section 203 to discharge a sufficient quantity of charges according to a necessary quantity of heat.

The CPU 3 keeps the selected switching element(s) 209 on. The CPU 3 keeps the other switching elements 209 off. After executing these kinds of setting, the CPU 3 transitions the mode to the electricity saving mode.

In Act A8, the CPU 3 sends an instruction to the changeover switch section 10. The changeover switch section 10 switches the power supply source from the low-voltage power supply section 8 to the electricity storing section 203.

In Act A9, electric power is supplied from the electricity storing section 203 to the motor driver 24*f* and the fan motor 57. The switching element(s) 209 kept on continue(s) to discharge, whereby the fan 37 rotates and the heater 27 is cooled by the fan wind.

The temperature falls below the target temperature (TP-sn) at a certain instance. After a predetermined time elapses from the instance, the stored electricity decreases to zero. The predetermined time is a set time determined in advance by heat calculation or the like such that the temperature of the fixing device 23 does not excessively fall. The discharge naturally ends and the rotation of the fan 37 stops.

In Act A10, the CPU 3 maintains the electricity saving mode.

If the detected temperature T is higher than the first temperature TP1 in Act A4 (No in Act A4), in Act A11, the CPU 3 determines whether the detected temperature T is lower than the second temperature TP2.

If a determination result is affirmative (Yes in Act A11), in Act A12, the CPU 3 sets the cooling time to t2. In Act A13, the CPU estimates, using the characteristic graph, electric energy for causing the fan 36 to operate for the time t2 and determines discharged electricity Cap-2 from the electricity storing device 208.

In Act A14, the CPU 3 selects and turns on all or a part of the plural switching elements 209 connected to the capacitor blocks 210. The CPU 3 continues to execute the processing in Act A8.

If the detected temperature T is higher than the second temperature TP2 in Act A11 (No in Act A11), in Act A15, the CPU 3 determines that the detected temperature T is lower than the temperature TPn.

In Act A16, the CPU 3 sets the cooling time to tn. In Act A17, the CPU 3 estimates, using the characteristic graph, electric energy for causing the fan 36 to operate for the time tn and determines discharged electricity Cap-n from the electricity storing device 208.

In Act A18, the CPU 3 selects and turns on all or a part of the plural switching elements 209 connected to the capacitor blocks 210. The CPU 3 continues to execute the processing in Act A8.

The color copying machine 500 according to the example in the past energizes the temperature sensors for the respective sections and the temperature detecting circuits for the respective sections even after the mode is transitioned to the electricity saving mode (or a preheating mode) in order to always detect temperature.

The color copying machine 200 according to the second embodiment does not need to energize the temperature sensor 30 and the temperature detecting circuits 24*a*. It is also possible to reduce electric power in the control side circuit.

The supply of electric power to the area (A) surrounded by the dotted line in FIG. 7 can be stopped. The color copying machine 200 can reduce power consumption in the electricity saving mode. Therefore, it is possible to improve energy consumption of the color copying machine 200.

Further, it is possible to appropriately set the length of time for causing the motor driver 24*f*, the fan motor 57, and the fan 36 to operate. Therefore, it is also possible to obtain effects that, for example, noise is reduced and the apparatus is not excessively cooled.

The discharged electricity and the stored electricity are substantially equivalent. Since the color copying machine 200 drives the fan motor 57 only for time read out from the two kinds of tables 59*a* and 59*b*, excessive discharge does not occur. The shortage of discharge does not occur, either. Therefore, the fixing device 23 is prevented from being excessively cooled.

It is possible to suppress consumption of electric power required for reheating due to excessive cooling. When the electricity storing section 203 is charged next time, it is sufficient to charge the electricity storing section 203 by a quantity used for discharge.

As the electricity storing section 203, a battery pack including plural lithium ion secondary cells may be used. The lithium ion secondary cell has a cell capacity of a single cell. The CPU 3 calculates the number of single cells corresponding to discharged electricity and switches the electricity storing section 203.

In the example explained above, the first table 59*a* associates the detected temperature and the cooling time and the second table 59*b* associates the cooling time and the stored electricity. However, the CPU 3 may use another table that stores a relation in which the detected temperature and the stored electricity are associated.

(Modification of the Second Embodiment)

When the stored electricity of the electricity storing section 203 is insufficient compared with electric energy for cooling, the CPU 3 suspends switching by the changeover switch section 10 until a point in time when the remaining stored electricity is exhausted and it is possible to cool the temperature of the heater 27 to target temperature comes.

Figure 10:
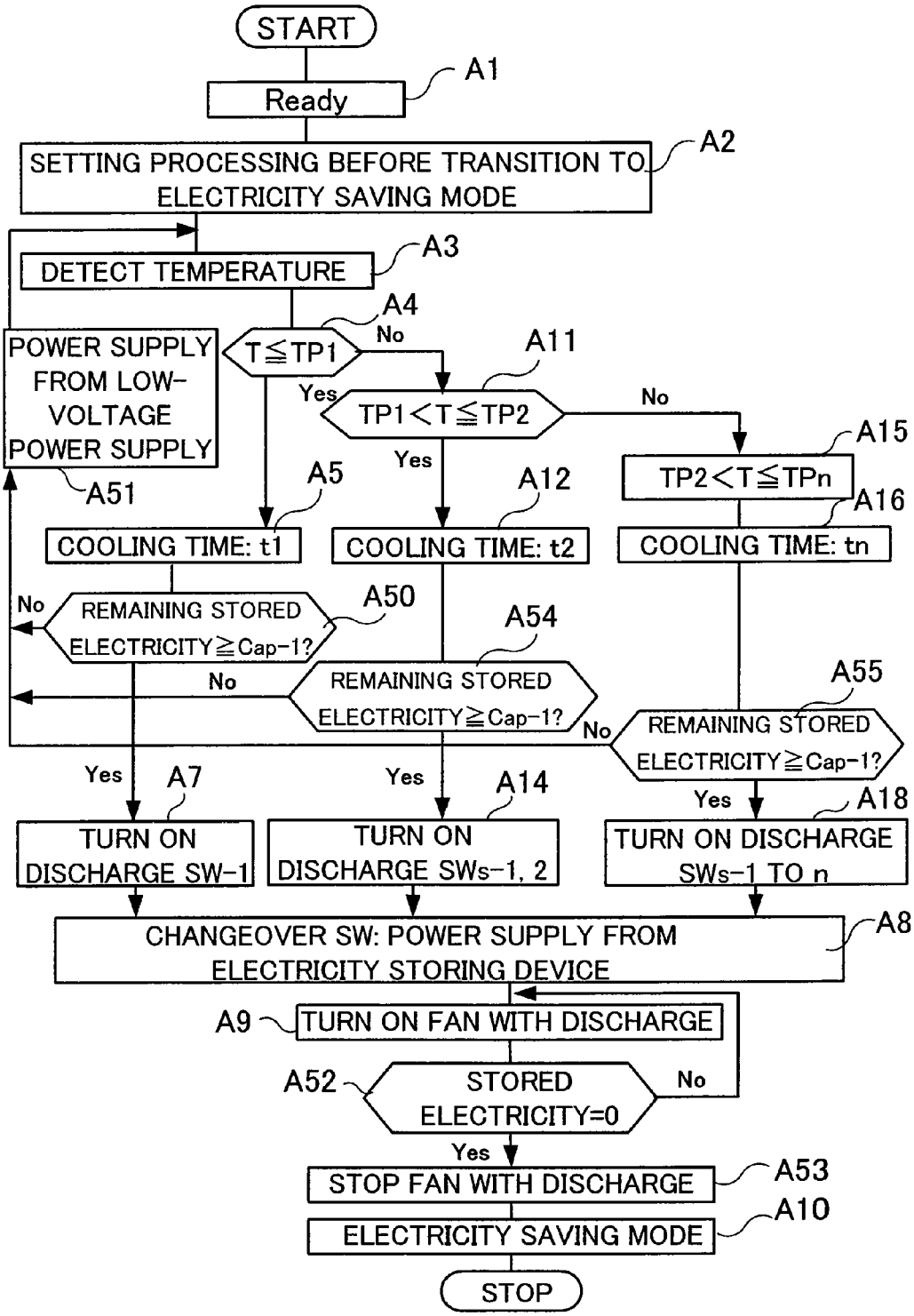
FIG. 10 is another flowchart for explaining the power supply switching processing by the first control circuit in the electricity saving mode.

FIG. 10 is another flowchart for explaining the power supply switching processing by the CPU 3 in the electricity saving mode. In the figure, acts same as those shown in FIG. 9 are denoted by the same reference signs.

The CPU 3 detects temperature (Act A3) and determines whether the detected temperature T is equal to or lower than the temperature TP1 (Act A4). If a determination result is affirmative (Yes in Act A4), the CPU 3 sets the cooling time to t1 (Act A5).

Subsequently, the CPU 3 determines the discharged electricity Cap-1 using the relation shown in FIG. 8B (Act A50). In Act A50, the CPU 3 acquires stored electricity at that point from the stored-electricity monitoring section 43.

The CPU 3 determines whether the remaining electricity acquired from the stored-electricity monitoring section 43 is the same as or larger than the discharged electricity Cap-1.

If the remaining stored electricity is insufficient (No in Act A50), in Act A51, the CPU 3 supplies electric power to the motor driver 24*f* and the fan motor 57 from the low-voltage power supply section 8. Thereafter, the CPU 3 proceeds to Act A3 and enters a state for always monitoring temperature.

The CPU 3 monitors temperature until the detected temperature T falls to temperature at which the electricity storing section 203 alone can cover electric power for the motor driver 24*f*, the fan motor 57, and the like.

While monitoring temperature, the CPU 3 calculates the remaining electricity according to the detected temperature and the tables 59*a* and 59*b*. If the CPU 3 determines in Act A50 that the remaining stored electricity is larger than the discharged electricity Cap-1 (Yes in Act A50), in Act A7, the CPU 3 selectively turns on the switching elements 209 by the number corresponding to the discharged electricity Cap-1.

Specifically, when electric energy necessary for cooling exceeds the stored electricity, the CPU 3 switches the source of power supply to supply electric power from the electricity storing section 203 to the motor driver 24*f* and the fan motor 57.

Subsequently, in Act A8, the CPU 3 switches the changeover switch section 10. The changeover switch section 10 switches the source of power supply from the low-voltage power supply section 8 to the electricity storing section 203.

In Act A9, electric power is supplied from the electricity storing section 203 to the motor driver 24*f* and the fan motor 57. The switching element(s) 209 kept on discharge(s). The fan 37 rotates and the heater 27 is cooled by fan wind.

In Act A52, the CPU 3 determines whether the stored electricity is 0. If the stored electricity is not 0 (No in Act A52), the CPU 3 continues to monitor the output of the temperature detecting circuit 24*a*.

If the stored electricity is 0 in Act A52 (Yes in Act A52), the CPU 3 determines that the fan 36 is stopped by discharge (Act A53). The CPU 3 maintains the electricity saving mode (Act A10).

The CPU 3 does not switch the source of power supply until detected temperature at the present point in time reaches temperature at which it is possible to lower the temperature of the heater 27 from the detected temperature to the target temperature.

In the color copying machine 200 proposed in the second embodiment, as in the color copying machine 1 proposed in the first embodiment, the circuit including the electricity storing section 203 is configured in the driving system circuit section, the fans 36 and 37 and the like are caused to operate by the electric power supplied from the electricity storing section 203, and the power supply from the AC-to-DC conversion circuit for driving 60*b* to the fans 36 and 37 and the like is interrupted.

The color copying machine 200 functions to estimate driving time of the fan motors 57 and 58 necessary for cooling according to a temperature detection result before transitioning to the electricity saving mode and determines electric energy discharged by the electricity storing device 208.

Consequently, the rotation of the fans 36 and 37 and the like stops simultaneously when the discharge of the electricity storing device 208 is completed. Therefore, it is possible to perform cooling operation without a feedback function for always monitoring temperature.

When the power supply from the AC-to-DC conversion circuit for driving 60*b* is interrupted, the color copying machine 200 interrupts an AC component of the low-voltage power supply section 8 using the relay switch section 70 or the like in the input section for detection of the body cover. By adopting such a configuration, it is possible to reduce a power loss in the power supply, leading to a reduction in the primary side power consumption.

(Other Modifications)

In the embodiments, the mode in the standby state branches to the ready mode and the electricity saving mode. However, the superiority of the image forming apparatus is not spoiled at all with respect to an invention that is merely carried out by using another mode substantially the same as the electricity saving mode and having a different mode name.

A configuration of a power transmission mechanism different from that of the example shown in FIG. 1 can be used in the color copying machine 1 according to a model of the color copying machine 1. It should not be considered that the determination concerning which of the motors 50, 51, 52, 53, 54, and 55 and the not-shown other motors is stopped and which of the motors is rotated is limited by the motor types of the motors.

The motors 51 are separately provided for the respective photoconductive drums 16. However, rotation force may be transmitted to the photoconductive drums 16 from one drum motor via gears.

It is possible to respectively distribute functions necessary for the driving boards to plural boards or mount the functions on the same board. For example, a method of configuring the driving board 24 and a mounting place for an IC can be variously changed.

In the embodiments, the relay switch is used as the changeover switch section 10. However, a semiconductor device such as a transistor can be used as a switching device.

In the embodiments, the AC relay is used as the relay switch section 70. However, a semiconductor device such as a transistor can be use as a switching device.

The circuits shown in FIGS. 1, 2A, 2B, 3, and 4A to 4C are only examples. The configurations of these circuits can be variously changed.

The fixing device 23 is heated by the heat roller 28. However, a halogen lamp heater may be provided in the press roller 29.

A level of power consumption is represented by a sum of the power consumption of the heater 27 and the power consumption of the halogen lamp heater. The main control section 6 controls the sum to be within the range of the power level specified by the Energy Star Program.

As the image forming apparatus, a monochrome copying machine, a printer, a facsimile, or an MFP may be used.

A system for detection of stored electricity of the stored-electricity monitoring section 43 is different according to a type of the electricity storing device 9*a*.

Not-shown another temperature sensor may be provided in the image forming unit 12. Temperature detecting circuits are provided on the driving boards. The temperature detecting circuits are connected to the control circuit sections 71 and 206.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A power supply unit for an image forming apparatus comprising:

a first control circuit configured to control the image forming apparatus that forms an image on a medium, to be transitioned among plural operation modes including a normal mode in which the image forming apparatus operates at normal power consumption and a power saving mode in which the image forming apparatus operates at other power consumption lower than the normal power consumption;

a first power system configured to receive first electric power supplied from a commercial power supply, and supply second electric power to at least the first control circuit;

a second power system configured to receive the first electric power supplied from the commercial power supply, and supply third electric power to a load further on a downstream side than the second power system;

an electricity storing section provided on a downstream side in a power supplying direction of the second power system and charged by the third electric power from the second power system in the normal mode;

a switch configured to turn off and on the first electric power from the commercial power supply to the second power system in association with open and close of a body cover, and generate fourth electric power;

a second control circuit to which the fourth electric power is supplied through the switch;

a cooling fan controlled by the second control circuit and configured to receive the third electric power supplied by the second power system; and a path switching section driven by the second control circuit and configured to switch, in the power saving mode, an electric power supply path to interrupt the third electric power from the second power system to the cooling fan and supply fifth electric power from the electricity storing section to the cooling fan.

2. The unit according to claim 1, further comprising a monitoring section configured to output information indicating stored electricity stored in the electricity storing section, wherein the second control circuit determines, in the power saving mode, according to the information transmitted from the monitoring section, whether the third electric power is supplied from the second power system to the cooling fan or the fifth electric power is supplied from the electricity storing section to the cooling fan.

3. The unit according to claim 2, further comprising a temperature detecting circuit configured to receive the second electric power supplied by the first power system and output detected temperature detected by a temperature sensor to the first control circuit, wherein the second control circuit deduces, according to an output from the temperature detecting circuit, time for continuing driving of the cooling fan and performs control to, if electric energy calculated according to the time is equal to or larger than electric energy stored in the electricity storing section, supply the third electric power from the second power system to the cooling fan and thereafter supply the fifth electric power from the electricity storing section to the cooling fan.

4. The unit according to claim 2, wherein the second control circuit keeps the electricity storing section discharging after switching the electric power supply path from the electricity storing section to the cooling fan.

5. The unit according to claim 1, wherein the switch generates DC power from the commercial power supply, interrupts supply of the DC power to the second control circuit in the power saving mode, and supplies the DC power to the second control circuit in the normal mode.

6. The unit according to claim 1, wherein the image forming apparatus includes:

a process section configured to execute a process requiring heat fixing on the medium;

a fixing device configured to fix a developer image on the medium with heat generated by a heat generating member using the electric power supplied from the commercial power supply;

a motor driving section for at least one motor configured to drive the process section and the fixing device; and a fan-motor driving section for a fan motor configured to drive the cooling fan, and in the power saving mode, the second control circuit supplies the fifth electric power supplied from the electricity storing section to the cooling fan, to the fan-motor driving section and the cooling fan cools heat generated in the fixing device.

7. The unit according to claim 1, further comprising a temperature detecting circuit configured to receive the second electric power supplied by the first power system and output detected temperature detected by a temperature sensor to the first control circuit, wherein the second control circuit interrupts, according to transition from the normal mode to the power saving mode, the second electric power supplied from the first power system to the temperature sensor and the temperature detecting circuit.

8. The unit according to claim 1, wherein the electricity storing section stores, during the power saving mode, stored electricity with which operable to drive the cooling fan until temperature of a process section configured to execute a process requiring heat fixing on the medium falls to a target temperature.

9. The unit according to claim 1, further comprising:

a temperature detecting circuit configured to receive the second electric power supplied by the first power system and output detected temperature detected by a temperature sensor to the first control circuit; and a monitoring section configured to output information indicating stored electricity stored in the electricity storing device, wherein the electricity storing section includes plural electricity storing devices configured to respectively store charges, the monitoring section monitors electric energies respectively stored in the electricity storing devices, and if the first control circuit instructs transition to the power saving mode, the second control circuit calculates, according to an output from the temperature detecting circuit, electric energy necessary for time in which driving of the cooling fan is continued, designates necessary one of the plural electricity storing devices according to a monitoring result of the monitoring section, instructs the designated electricity storing device to supply the fifth electric power to the cooling fan, and, thereafter, causes the path switching section to switch the electric power supply path to the cooling fan.

10. The unit according to claim 9, further comprising:

a first table for storing a correspondence relation between the time and temperature detected by the temperature sensor; and a second table for storing a correspondence relation between stored electricity of the electricity storing section and a discharge time required for discharge of charges of the stored electricity, wherein the second control circuit calculates the electric energy from the detected temperature referring to the first table and the second table.

11. An image forming apparatus, comprising:

a process section configured to generate, with first electric power supplied from a commercial power supply, a developer image on a medium using an electrophotographic system;

a fixing device configured to fix the developer image on the medium with heat generated in a heat generating member using the first electric power supplied from the commercial power supply;

a first control circuit configured to control the process section and the fixing device to be transitioned among plural operation modes including a normal mode in which the image forming apparatus that forms an image on a medium operates at normal power consumption and a power saving mode in which the image forming apparatus operates at other power consumption lower than the normal power consumption;

a first power system configured to receive the first electric power supplied from the commercial power supply, and supply second electric power to at least the first control circuit;

a second power system configured to receive the first electric power supplied from the commercial power supply, and supply third electric power to a load further on a downstream side than the second power system;

a electricity storing section provided on a downstream side in a power supplying direction of the second power system and charged by the third electric power from the second power system in the normal mode;

a switch configured to turn off and on first electric power from the commercial power supply to the second power system in association with open and close of a body cover, and generate fourth electric power;

a second control circuit to which the fourth electric power is supplied through the switch;

a cooling fan controlled by the second control circuit and configured to receive the third electric power supplied by the second power system; and a path switching section driven by the second control circuit and configured to switch, in the power saving mode, an electric power supply path to interrupt the third electric power from the second power system to the cooling fan and supply the fifth electric power from the electricity storing section to the cooling fan.

12. The apparatus according to claim 11, further comprising a monitoring section configured to output information indicating stored electricity stored in the electricity storing section, wherein the second control circuit determines, in the power saving mode, according to the information transmitted from the monitoring section, whether the third electric power is supplied from the second power system to the cooling fan or the fifth electric power is supplied from the electricity storing section to the cooling fan.

13. The apparatus according to claim 12, further comprising a temperature detecting circuit configured to receive the second electric power supplied by the first power system and output detected temperature detected by a temperature sensor to the first control circuit, wherein the second control circuit deduces, according to an output from the temperature detecting circuit, time for continuing driving of the cooling fan and performs control to, if electric energy calculated according to the time is equal to or larger than electric energy stored in the electricity storing section, supply the third electric power from the second power system to the cooling fan and thereafter supply the fifth electric power from the electricity storing section to the cooling fan.

14. The apparatus according to claim 12, wherein the second control circuit keeps the electricity storing section discharging after switching the electric power supply path from the electricity storing section to the cooling fan.

15. The apparatus according to claim 11, wherein the switch generates DC power from the commercial power supply, interrupts supply of the DC power to the second control circuit in the power saving mode, and supplies the DC power to the second control circuit in the normal mode.

16. The apparatus according to claim 11, further comprising:

a motor driving section for at least one motor configured to drive the process section and the fixing device; and a fan-motor driving section for a fan motor configured to drive the cooling fan, wherein in the power saving mode, the second control circuit supplies the fifth electric power supplied from the electricity storing section to the cooling fan, to the fan-motor driving section and the cooling fan cools heat generated in the fixing device.

17. The apparatus according to claim 11, further comprising a temperature detecting circuit configured to receive the second electric power supplied by the first power system and output detected temperature detected by a temperature sensor to the first control circuit, wherein the second control circuit interrupts, according to transition from the normal mode to the power saving mode, the second electric power supplied from the first power system to the temperature sensor and the temperature detecting circuit.

18. The apparatus according to claim 11, wherein the electricity storing section stores, during the power saving mode, stored electricity with which operable to drive the cooling fan until temperature of the process section configured to execute a process requiring heat fixing on the medium falls to a target temperature.

19. The apparatus according to claim 11, further comprising:

a temperature detecting circuit configured to receive the second electric power supplied by the first power system and output detected temperature detected by a temperature sensor to the first control circuit; and a monitoring section configured to output information indicating stored electricity stored in the electricity storing device, wherein the electricity storing section includes plural electricity storing devices configured to respectively store charges, the monitoring section monitors electric energies respectively stored in the electricity storing devices, and if the first control circuit instructs transition to the power saving mode, the second control circuit calculates, according to an output from the temperature detecting circuit, electric energy necessary for time in which driving of the cooling fan is continued, designates necessary one of the plural electricity storing devices according to a monitoring result of the monitoring section, instructs the designated electricity storing device to supply the fifth electric power to the cooling fan, and, thereafter, causes the path switching section to switch the electric power supply path to the cooling fan.

20. The apparatus according to claim 19, further comprising:

a first table for storing a correspondence relation between the time and temperature detected by the temperature sensor; and a second table for storing a correspondence relation between stored electricity of the electricity storing section and a discharge time required for discharge of charges of the stored electricity, wherein the second control circuit calculates the electric energy from the detected temperature referring to the first table and the second table.

* * * * *